US006048681A

United States Patent [19]

Suzumoto et al.

[11] Patent Number: 6,048,681

[45] Date of Patent: Apr. 11, 2000

[54] SILVER HALIDE PHOTOGRAPHIC MATERIAL

[75] Inventors: Takeshi Suzumoto; Shigeharu Urabe; Katsuhiro Yamashita, all of Kanagawa, Japan

[73] Assignee: Fuji Photo Film Co., Ltd., Kanagawa, Japan

[21] Appl. No.: 09/177,102

[22] Filed: Oct. 22, 1998

[30] Foreign Application Priority Data

Oct. 24, 1997 [JP] Japan ..... 9-292882

[51] Int. Cl.[7] ..... G03C 1/035; G03C 1/08

[52] U.S. Cl. ..... 430/567; 430/569; 430/570

[58] Field of Search ..... 430/567, 569, 430/570

[56] References Cited

U.S. PATENT DOCUMENTS 5,587,281 12/1996 Saitou et al. ..... 430/567

5,985,535 11/1999 Urabe ..... 430/569

FOREIGN PATENT DOCUMENTS 0838719 4/1998 European Pat. Off. ..... G03C 1/005

64-91134 10/1989 Japan ..... G03C 1/10

10-239787 9/1998 Japan ..... G03C 1/015

*Primary Examiner*—Mark F. Huff

*Attorney, Agent, or Firm*—Sughrue, Mion, Zinn Macpeak & Seas, PLLC

[57] ABSTRACT

Disclosed is a silver halide photographic material having at least one silver halide emulsion layer containing a silver halide photographic emulsion, wherein the silver halide photographic emulsion comprises spectrally sensitized tabular silver halide grains having an average aspect ratio of from 8 to 100, and having light absorption strength by a sensitizing dye per unit surface area of the grain surface of 100 or more.

18 Claims, 2 Drawing Sheets

SILVER HALIDE PHOTOGRAPHIC MATERIAL

FIELD OF THE INVENTION

The present invention relates to a spectrally sensitized silver halide photographic emulsion and a method for producing the same, moreover, the present invention relates to a silver halide photographic material using the emulsion.

BACKGROUND OF THE INVENTION

Photographic characteristic of tabular silver halide grains (hereinafter referred to as "tabular grains") are described below.

1) Since the ratio of the surface area to the volume of a tabular grain is large, a large amount of a sensitizing dye can be adsorbed onto the surface of a grain, as a result, higher color sensitization sensitivity can be obtained;

2) When an emulsion which contains tabular grains are coated and dried, the grains are oriented in parallel with the surface of the support, therefore, the coated layer thickness can be made thin and the sharpness can be improved;

3) As tabular grains oriented in parallel with the support keep the shape and the orientation intact after development, the covering power of the developed silver is high. This characteristic, in particular in X-ray films, contributes to reduce the coating amount of silver required to obtain the same optical density;

4) Tabular grains oriented in parallel with the support exhibit less light scattering, therefore, an image having high definition can be obtained; and 5) As tabular grains are low sensitive to blue light, a yellow filter can be reduced or excluded from the emulsion when they are used in a green-sensitive layer or a red-sensitive layer.

In U.S. Pat. No. 4,439,520, a color photographic material whose sharpness, sensitivity and graininess are improved due to the use of tabular grains having a thickness of less than 0.3 μm, a diameter of 0.6 μm or more and an aspect ratio of 8 or more in at least one layer of a green-sensitive emulsion layer and a red-sensitive emulsion layer is disclosed. The aspect ratio used herein means the ratio of the diameter to the thickness of a tabular grain. The diameter of a tabular grain means the diameter of a circle having the same area as the projected area of a grain when an emulsion is observed using a microscope or an electron microscope. Further, the thickness of a tabular grain means the distance between two parallel main planes constituting the tabular grain.

In U.S. Pat. No. 4,693,964, a photographic element containing silver bromide or silver iodobromide tabular grains having an average grain size of from 0.4 to 0.55 μm and an aspect ratio of 8 or more is disclosed. In U.S. Pat. No. 4,693,964, tabular grains having an average grain size of 0.5 μm and a thickness of 0.04 μm are disclosed in the working examples. In U.S. Pat. No. 4,672,027, a photographic element containing silver bromide or silver iodobromide tabular grains having an average grain size of from 0.22 to 0.55 μm and an aspect ratio of 8 or more is disclosed. In U.S. Pat. No. 4,672,027, tabular grains having a thickness of 0.04 μm are disclosed in the working examples.

In U.S. Pat. No. 5,250,403, a color photographic element containing tabular grains having {111} main planes and having an average grain size of 0.7 μm or more and an average thickness of less than 0.07 μm in minus blue layers (a green-sensitive layer and/or a red-sensitive layer) is disclosed. Tabular grains having an average thickness of less than 0.07 μm are hereinafter referred to as "extremely thin" tabular grains. In U.S. Pat. No. 5,250,403, extremely thin tabular grains are attractive in view of the relationship between sensitivity and graininess, and it is advantageous to use extremely thin tabular grains in color photographic elements, in particular, in minus blue recording emulsion layers, in view of excellent sharpness of images.

In European Patent 362699, tabular grains having the ratio of the aspect ratio to the diameter of tabular grains of more than 0.7 are disclosed. In this European Patent, the preparation of tabular grains having a thickness of 0.04 μm are disclosed in the working examples.

Thus, studies have been heretofore concentrated on the development of tabular grains having higher aspect ratio and thinner thickness to exhibit higher characteristics of tabular grains. On the other hand, the higher quality of photographs has been strongly required, therefore, the development of techniques capable of achieving higher sensitivity has been desired.

As described above, since tabular grains have high ratio of the surface area to the volume, a large amount of a sensitizing dye can be adsorbed onto the surface of a grain, as a result, higher color sensitization sensitivity can be obtained. It is thought that the light energy transmission efficiency to silver halide is improved in a sensitizing dye by increasing the light absorption rate by virtue of the adsorption of a large amount of a sensitizing dye and the higher sensitization of the spectral sensitivity can be achieved.

However, there is limitation on the adsorption amount of a sensitizing dye onto the surface of silver halide grains and it is difficult to adsorb a sensitizing dye of the amount more than the saturation adsorption of a single layer. Accordingly, in the present situation, the absorption rate of the incident light quantum of each silver halide grain in the spectral sensitization region is still extremely low even when tabular grains are used.

Methods suggested for resolving these drawbacks are shown below.

P. B. Gilman, Jr. et al. made a cationic dye adsorb on the first layer and an anionic dye on the second layer using electrostatic force as disclosed in *Photographic Science and Engineering*, Vol. 20, No. 3, page 97 (1976).

G. B. Bird et al. made a plurality of dyes multilayer-adsorb on silver halide and sensitization was effected by virtue of Forster type excitation energy transfer as disclosed in U.S. Pat. No. 3,622,316.

Sugimoto et al. performed spectral sensitization by energy transfer from a luminescent dye as disclosed in JP-A-63-138341 and JP-A-64-84244 (the term "JP-A" as use herein means an "unexamined published Japanese patent application").

R. Steiger et al. tried spectral sensitization by energy transfer from a gelatin-substituted cyanine dye as disclosed in *Photographic Science and Engineering*, Vol. 27, No. 2, page 59 (1983).

Ikekawa et al. performed spectral sensitization by energy transfer from a cyclodextrin-substituted dye as disclosed in JP-A-61-251842.

So-called connecting dyes respectively having two chromophores which are not conjugated separately and connected by a covalent bond are disclosed in U.S. Pat. Nos. 2,393,351, 2,425,772, 2,518,732, 2,521,944, 2,592,196 and European Patent 565083. However, these dyes were not dyes aiming at the improvement of light absorption rate. As the dyes aiming at the improvement of light absorption rate actively, G. B. Bird, A. L. Borror et al. made connecting type sensitizing dye molecules having a plurality of cyanine chromophores adsorb onto silver halide to heighten the light absorption rate and contrived sensitization by the contribution of energy transfer as disclosed in U.S. Pat. Nos. 3,622,317 and 3,976,493. Ukai, Okazaki and Sugimoto proposed in JP-A-64-91134 to connect at least one substantially non-adsorptive cyanine, merocyanine or hemicyanine dye containing at least two sulfo groups and/or carboxyl groups to a spectral sensitizing dye adsorbable onto silver halide.

L. C. Vishwakarma disclosed in JP-A-6-57235 a method of synthesizing a connecting dye by a dehydration condensation reaction of two dyes. Further, L. C. Vishwakarma showed in JP-A-6-27578 that a connecting dye comprising monomethine cyanine and pentamethine oxonol had red-sensitivity, but in this case spectral sensitization due to Forster type excitation energy transfer among dyes was not effected because the luminescence of the oxonol dye did not overlap with the absorption of the cyanine dye. Therefore, higher sensitization by the light converging function of the connected oxonol cannot be obtained.

M. R. Roberts et al. suggested spectral sensitization by a cyanine dye polymer in U.S. Pat. No. 4,950,587.

As described above, numerous examinations have been conducted heretofore for the improvement of light absorption rate, but none of them was satisfactory in higher sensitization effect and there remained such problems as the increase of intrinsic desensitization and development inhibition.

From the above reasons, techniques of spectral sensitization to improve the light absorption rate of silver halide to ensure higher sensitization have been demanded.

SUMMARY OF THE INVENTION

An object of the present invention is to provide a silver halide photographic material having high sensitivity.

As a result of eager studies, the present inventors have found the above object of the present invention can be achieved by the following.

(1) A silver halide photographic material having at least one silver halide emulsion layer containing a silver halide photographic emulsion, wherein the silver halide photographic emulsion comprises spectrally sensitized tabular silver halide grains having an average aspect ratio of from 8 to 100, and having light absorption strength by a sensitizing dye per unit surface area of the grain surface of 100 or more.

Herein, the light absorption strength by a sensitizing dye per unit surface area is defined as the value obtained by integrating optical density Log $[I_0/(I_0-I)]$ to wave number ($cm^{-1}$), taking the incident light amount on the unit surface area of the grain as $I_0$ and the light amount absorbed by the sensitizing dye on the surface as I. The region of integration is from 5,000 $cm^{-1}$ to 35,000 $cm^{-1}$.

(2) A silver halide photographic material having at least one silver halide emulsion layer containing a silver halide photographic emulsion, wherein the silver halide photographic emulsion comprises tabular silver halide grains spectrally sensitized at a spectral absorption maximum wavelength of 500 nm or less having an average aspect ratio of from 8 to 100, and having light absorption strength by a sensitizing dye per unit surface area of the grain surface of 60 or more and less than 100.

Herein, the light absorption strength by a sensitizing dye per unit surface area is the same as the light absorption strength by a sensitizing dye per unit surface area as defined in the above item (1).

(3) The silver halide photographic material as described in the above (1) or (2), wherein the silver halide photographic emulsion is a tabular grain emulsion prepared by the method comprising:

supplying a water-soluble silver salt aqueous solution and a water-soluble halide aqueous solution to a mixing chamber installed outside the reaction vessel where a nucleation process and/or a grain growing process are(is) carried out, and mixing the solutions to form silver halide fine grains, and immediately supplying the silver halide fine grains to the reaction vessel and nucleation and/or grain growth of silver halide grains are(is) conducted in the reaction vessel.

(4) The silver halide photographic material as described in the above (3), wherein the mixing chamber comprises:

a closed type stirring tank equipped with a prescribed number of solution supply ports for supplying addition solutions to be subjected to stirring and a solution exhaust port for exhausting silver halide fine grains which are formed by the completion of the stirring process, and stirring means for controlling the stirring condition of the mixture of aqueous solutions supplied by rotation driving at least one pair of stirring blades not having a rotary shaft protruding the wall of the stirring tank.

(5) The silver halide photographic material as described in any one of the above (1) to (4), wherein the silver halide photographic emulsion contains a silver halide emulsion prepared in the presence of gelatin to which at least one carboxyl group (a —COOH group) is newly introduced when the amino group (an $—NH_2$ group) in gelatin is chemically modified.

(6) The silver halide photographic material as described in any one of the above (1) to (5), wherein the silver halide photographic emulsion is produced by the method comprising (a) a process of forming silver halide grain nuclei containing twin crystal grain nuclei in a dispersion medium solution, (b) a process of ripening the silver halide grain nuclei to leave tabular grain nuclei primarily, and (c) a process of growing the resultant tabular grain nuclei to tabular grains, and the Cl content of the nuclei based on the silver amount in process (a) is at least 10 mol % or more.

DETAILED DESCRIPTION OF THE INVENTION

Figure 1:
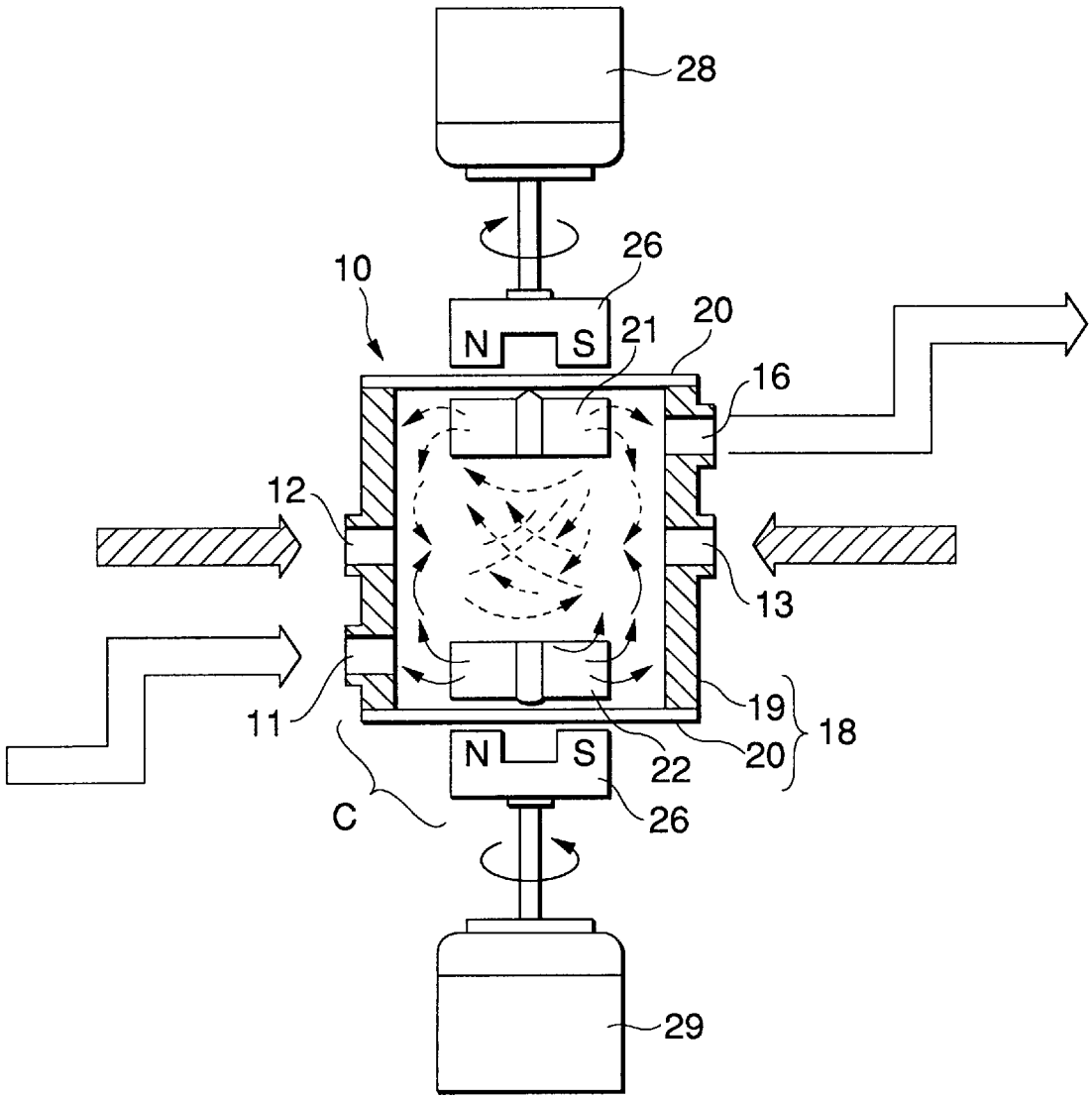
FIG. 1 is a cross sectional view showing the schematic construction of the stirring apparatus according to the present invention.

The present invention will be described in detail below.

The silver halide emulsion which can be used in the silver halide photographic material of the present invention comprises a tabular silver halide grain having adsorbed on the surface thereof a sensitizing dye according to the present invention and having a higher surface area/volume ratio. The tabular silver halide grain according to the present invention has an aspect ratio of from 8 to 100, preferably from 15 to 80, and more preferably from 20 to 80, a tabular grain thickness of less than 0.2 μm, preferably less than 0.1 μm, and more preferably less than 0.07 μm. The following techniques can be applied for the preparation of such a tabular grain having high aspect ratio and thin thickness.

The producing method of silver halide emulsion according to the present invention is described in detail below.

The silver halide emulsion according to the present invention can be produced through a process of nucleation→ripening→growth.

Each process of nucleation, ripening and growth are described below.

1. Nucleation

The nucleation of tabular grains is in general carried out by a double jet method comprising adding a silver salt aqueous solution and an alkali halide aqueous solution to a reaction vessel containing a protective colloid aqueous solution, or a single jet method comprising adding a silver salt aqueous solution to a protective colloid solution containing alkali halide. If necessary, a method comprising adding an alkali halide aqueous solution to a protective colloid solution containing silver salt may be used. Further, if necessary, a method comprising adding a protective colloid solution, a silver salt solution and an alkali halide aqueous solution to the mixer disclosed in JP-A-2-44335, and immediately transfer the mixture to a reaction vessel may be used for the nucleation of tabular grains. Further, as disclosed in U.S. Pat. No. 5,104,786, nucleation can be performed by passing an aqueous solution containing alkali halide and a protective colloid solution through a pipe and adding a silver salt aqueous solution thereto.

Gelatin is used as protective colloid but natural high polymers besides gelatin and synthetic high polymers can also be used in the present invention. Alkali-processed gelatin, oxidized gelatin, i.e., gelatin in which a methionine group in the gelatin molecule is oxidized with hydrogen peroxide, etc. (a methionine content of 40 μmol/g or less), amino group-modified gelatin (e.g., phthalated gelatin, trimellitated gelatin, succinated gelatin, maleated gelatin, and esterified gelatin), and low molecular weight gelatin (molecular weight of from 3,000 to 40,000) are used. Further, natural high polymers are described in JP-B-7-111550 (the term "JP-B" as used herein means an "examined Japanese patent publication") and *Research Disclosure*, Vol. 176, No. 17643, item IX (December, 1978).

Excessive halides in the nucleation according to the present invention are $Cl^-$, $Br^-$ and $I^-$, and they can be used alone or in combination. The concentration of excessive halides is from $3\times10^{-5}$ mol/liter to 0.1 mol/liter, preferably from $3\times10^{-4}$ mol/liter to 0.01 mol/liter.

The temperature in the nucleation according to the present invention is preferably from 5 to 60° C., but when fine tabular grains having an average grain size of 0.5 μm or less are produced, the temperature is more preferably from 5 to 48° C.

The pH of the dispersion medium when amino group-modified gelatin is used is preferably from 4 to 8 but when other gelatins are used it is preferably from 2 to 8.

2. Ripening

In the nucleation described in 1. above, fine grains other than tabular grains are formed (in particular, octahedral and single twin grains). Accordingly, the grains other than tabular grains are necessary to be vanished before entering the following described growing process to obtain nuclei having the forms of becoming tabular grains and good monodispersibility. For this purpose, it is well known that Ostwald ripening is conducted subsequent to the nucleation.

pBr is adjusted just after nucleation, then the temperature is raised and ripening is carried out until the hexagonal tabular grain ratio reaches the maximum. At this time, protective colloid may be added additionally. The concentration of protective colloid to the dispersion medium solution at this time is preferably 10 wt % or less. The above-described alkali-processed gelatin, amino group-modified gelatin, oxidized gelatin, low molecular weight gelatin, natural high polymers and synthetic high polymers can be used as additional protective colloids.

Ripening is conducted at 40° C. to 80° C., preferably from 50° C. to 80° C., and pBr of from 1.2 to 3.0. pH is preferably from 4 to 8 when amino group-modified gelatin is used, and preferably from 2 to 8 when other gelatins are used.

A silver halide solvent may be used for rapidly vanishing grains other than tabular grains. The concentration of the silver halide solvent at this time is preferably from 0.3 mol/liter or less, more preferably 0.2 mol/liter or less. When the tabular grains are used as an emulsion for direct reversal use, neutral or acidic thioether compounds are better than alkaline $NH_3$ solvents.

Thus, almost pure tabular grains are obtained by the ripening.

After the ripening is finished, if the silver halide solvent is unnecessary in the next growth stage, the silver halide solvent is removed as follows.

(1) In the case of alkaline silver halide solvents such as $NH_3$, an acid having large solubility product with $Ag^+$such as $HNO_3$ is added to be nullified.

(2) In the case of thioether based silver halide solvent, an oxidizing agent such as $H_2O_2$ is added to be nullified as disclosed in JP-A-60-136736.

3. Growth

The pBr during the crystal growing stage subsequent to the ripening process is preferably maintained at 1.4 to 3.5. When the concentration of protective colloid in a dispersion medium solution before entering the growing process is low (1 wt % or less), protective colloid is additionally added in some cases. The concentration of protective colloid in a dispersion medium solution at that time is preferably from 1 to 10 wt %. The above-described alkali-processed gelatin, amino group-modified gelatin, oxidized gelatin, natural high polymers and synthetic high polymers can be used as additional protective colloids. pH during growing is preferably from 4 to 8 when amino group-modified gelatin is present, and preferably from 2 to 8 when other gelatins are used. The feeding rate of $Ag^+$ and a halogen ion in the crystal growing stage is preferably adjusted to such a degree that the crystal growing speed becomes from 20 to 100%, more preferably from 30 to 100%, of the critical growing speed of the crystal. In this case, the feeding rates of a silver ion and a halogen ion are increased with the crystal growth of the grains and, as disclosed in JP-B-48-36890 and JP-B-52-16364, the feeding rates of an aqueous solution of silver salt and an aqueous solution of halide may be increased, alternatively, the concentrations of an aqueous solution of silver salt and an aqueous solution of halide may be increased.

Growing of silver halide grains can be performed by supplying a silver salt aqueous solution and a halide aqueous solution to a mixing chamber installed outside the reaction vessel, if necessary, protective colloid solution is further added, mixing and stirring the solutions to form silver halide fine grains, and immediately supplying the resultant silver halide fine grains to the reaction vessel to carry out the growth of silver halide grains in the reaction vessel. At this time, protective colloid (gelatin, synthetic high polymer, etc.) may be dissolved in the halide aqueous solution. As for this method, JP-A-10-43570 can be referred to.

Tabular silver halide grains having the halogen composition of silver chloride, silver bromide, silver chlorobromide, silver iodobromide, silver chloroiodobromide or silver iodochloride are used in the emulsion for use in the present invention. Tabular grains have {100} or {111} main planes. Tabular grains having {111} main planes (hereinafter referred to as {111} tabular grains) have, in general, triangular or hexagonal planes. When the grain size distribution becomes uniform, the ratio of tabular grains having hexagonal planes increases. Hexagonal monodisperse tabular grains are disclosed in JP-B-5-61205.

Tabular grains having {100} main planes (hereinafter referred to as {100} tabular grains) have rectangular or square shapes. In the emulsion of this type, grains having a ratio of adjacent side lengths of less than 5/1 are called tabular grains not acicular grains. In silver chloride tabular grains or high silver chloride content tabular grains, {100} tabular grains fundamentally exhibit higher stability of main plane surface as compared with {111} tabular grains. In the case of {111} tabular grains, it is necessary to stabilize {111} main plane surface. Methods thereof are disclosed in JP-A-9-80660, JP-A-9-80656 and U.S. Patent No. 5,298,388.

It is effective to use a polymer having a repeating unit represented by the following formula (1) for the monodispersion of {111} tabular grains:

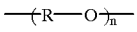

(1)

wherein R represents an alkylene group having from 2 to 10 carbon atoms; and n represents the average number of repeating units, which is from 4 to 200.

In the formation of the emulsion for use in the present invention, a polymer having a repeating unit represented by formula (1) is preferably used, and a vinyl polymer having at least one monomer represented by formula (2) as a constituent or polyurethane represented by formula (3) is preferably used. A vinyl polymer having a repeating unit represented by formula (2) is particularly preferably used.

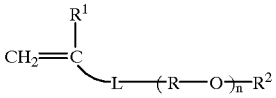

(2)

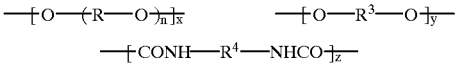

(3)

In formula (2), R represents an alkylene group having from 2 to 10 carbon atoms; n represents the average number of repeating units, which is from 4 to 200; $R^1$ represents a hydrogen atom or a lower alkyl group; $R^2$ represents a monovalent substituent; and L represents a divalent linking group.

In formula (3), $R^3$ and $R^4$ each represents an alkylene group having from 1 to 20 carbon atoms, a phenylene group having from 6 to 20 carbon atoms, or an aralkylene group having from 7 to 20 carbon atoms; and x, y and z each represents weight percentage of each constituent, x represents from 1 to 70, y represents from 1 to 70, and z represents from 20 to 70, and x+y+z=100. Further detailed examples and general descriptions are disclosed in European Patents 513722, 513723, 513724, 513725, 514742, 514743, 518066 and JP-A-9-54377.

In the preparation of tabular grains having high aspect ratio, it is particularly effective to use gelatin of a low methionine content at formation of tabular grains, which is disclosed in JP-B-5-12696. Further, tabular grains having higher aspect ratio and thin thickness can be obtained by using amino group-modified gelatin. As for specific methods of modification of amino groups, U.S. Pat. Nos. 2,525,753, 3,118,766, 2,614,928, 2,614,929, JP-B-40-15585, JP-A-8-82883 and *Nihon Shashin Gakkai-Shi*, Vol. 58, page 25 (1995) can be referred to.

In the production of extremely thin tabular grains having high aspect ratio for use in the present invention, it is preferred to supply a water-soluble silver salt aqueous solution and a water-soluble halide aqueous solution to a mixing chamber installed outside the reaction vessel where a nucleation process and/or a grain growing process are(is) carried out, and mix the solutions to form silver halide fine grains, and immediately supply the silver halide fine grains to the reaction vessel and conduct nucleation and/or grain growth of silver halide grains in the reaction vessel. This method is disclosed in U.S. Pat. Nos. 4,879,208, 5,035,991, 5,270,159, European Patent 507701 and U.S. Pat. No. 5,250,403.

Figure 2:
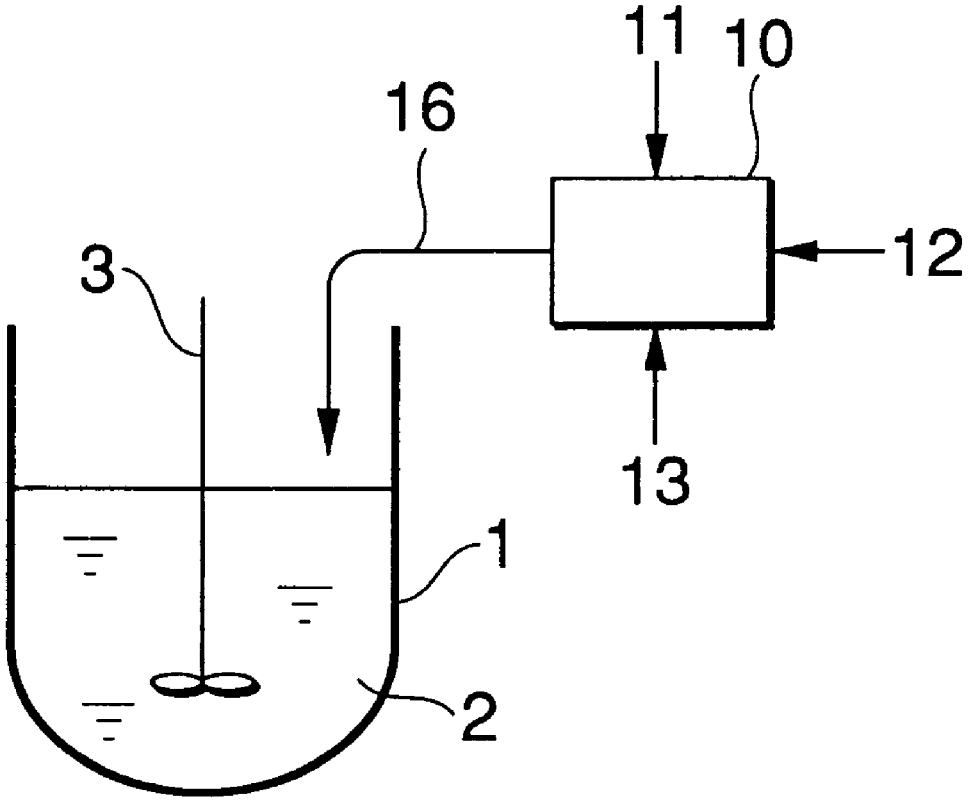
FIG. 2 is a schematic cross sectional view showing the producing process of the silver halide emulsion according to the present invention.

The system of conducting the above-described nucleation and/or grain growth according to the present invention is shown in FIG. 2. In FIG. 2, a reaction vessel 1 contains a protective colloid aqueous solution 2. The protective colloid aqueous solution is stirred by stirring blades 3 attached to a rotary shaft (shown as a propeller type in this figure). A silver salt aqueous solution, a halide aqueous solution and, if necessary, a protective colloid aqueous solution are respectively introduced to a mixing chamber 10 installed outside of the reaction vessel through an addition system (supply ports 11, 12 and 13). (In this case, if necessary, the protective colloid aqueous solution may be added in admixture with the silver salt aqueous solution and/or the halide aqueous solution.) These solutions are rapidly and vigorously mixed in the mixing chamber, immediately introduced to the reaction vessel 1 through an exhaust port 16 and nucleation is conducted in the reaction vessel. At this time, the emulsion exhausted from the mixing chamber can be reserved in other container and added later to the reaction vessel.

After nucleation is finished in the reaction vessel, a silver salt aqueous solution, a halide aqueous solution and, if necessary, a protective colloid aqueous solution are further respectively introduced to the mixing chamber 10 through supply ports 11, 12 and 13. (In this case, if necessary, the protective colloid aqueous solution may be added in admixture with the silver salt aqueous solution and/or the halide aqueous solution.) These solutions are rapidly and vigorously mixed in the mixing chamber, immediately and continuously introduced to the reaction vessel 1 through the exhaust port 16 and the growth of nuclei already formed in the reaction vessel is conducted in the reaction vessel.

The mixing apparatus for forming silver halide fine grains for use in the present invention is further described below. Details thereof are disclosed in JP-A-10-43570.

The mixing apparatus consists of a stirring tank provided with a prescribed number of solution supply ports for supplying a water-soluble silver salt and a water-soluble halide to be stirred and a solution exhaust port for exhausting the silver halide fine grain emulsion after stirring processing, and stirring means for controlling the stirring condition of the solution in the stirring tank by rotation driving stirring blades. Stirring and mixing is conducted in the stirring tank by two or more stirring blades which are rotation driven, and these at least two stirring blades are disposed confronting with each other with a distance between and rotation driven in converse directions. Each of the stirring blades has a magnetic coupling relation with the outer magnet disposed outside the tank wall adjacent to each stirring blade and each stirring blade does not have a rotary shaft protruding the tank wall and rotation driven by the motor connected to the outer magnet. A double sided bipolar magnet comprising an N pole face and an S pole face disposed so as to be parallel to a central axis line of rotation and superposed interposing the central axis of rotation is used in one of the stirring blades and the outer magnet coupled by magnetic coupling and a bilateral bipolar magnet comprising an N pole face and an S pole face standing abreast at symmetrical positions to the central axis of rotation on the plane orthogonal to the central axis line of rotation is used in another.

The executing mode of the mixing chamber (stirring apparatus) according to one embodiment of the present invention shown in FIG. 1 is described below.

A stirring tank 18 consists of a tank body 19 having a central axis of rotation facing in top and bottom directions and seal plates 20 which function as tank walls sealing top and bottom opening ends of the tank body 19. Stirring blades 21 and 22 are disposed at the top and bottom ends of the stirring tank 18 confronting with each other with a distance between and rotation driven in converse directions. Stirring blades 21 and 22 each constitutes magnetic coupling C with an outer magnet 26 disposed outside the tank wall adjacent to each stirring blade 21 and 22. That is, each stirring blade 21 and 22 is linked to each outer magnet 26 by magnetic force and rotation operated in converse directions by rotation driving each outer magnet by independent motors 28 and 29, respectively.

A stirring tank 18 comprises solution supply ports 11, 12 and 13 for supplying a silver salt aqueous solution, a halide aqueous solution and, if necessary, a colloid aqueous solution to be stirred and a solution exhaust port 16 for exhausting the silver halide fine grain emulsion after stirring processing.

In the present invention, when opposite stirring blades are driven in the mixing chamber, the rotation speed is 1,000 rpm or more, preferably 3,000 rpm or more. Conversely rotating stirring blades may be rotated at the same rotating speed or different rotating speeds.

In tabular grain formation process in the present invention, at least during ripening or before growing process, ions other than halide may be added. It is preferred that ionic strength in a dispersion medium solution at this time is at least from 0.2 to 2.0, more preferably from 0.3 to 1.0. Preferred ions are described below but ions are not limited thereto.

As ions having positive electric charge, there can be cited $H^+$, $Na^+$, $Mg^{2+}$, $Ca^{2+}$, $K^+$, $Ba^{2+}$, $Sr^{2+}$, $Co^{2+}$, $Ni^{2+}$, $Cu^{2+}$, $Zn^{2+}$, $Al^{2+}$, etc., and divalent or more ions are preferred.

As ions having negative electric charge, $OH^-$, $NO_3^-$, $SO_4^{2-}$, $ClO_4^-$, $BF_4^-$, $BF_6^-$, $N_3^-$, $CN^-$, $C_2O_4^{2-}$, $SCN^-$, $CO_3^{2-}$, $COO^-$, etc., can be cited.

These ions are supplied as an inorganic salt aqueous solution. Examples of inorganic salts are described in Kagaku Benran, Kiso-Hen II (*Handbook of Chemistry, Elementary Course II*), pages 453–455 (published by Maruzen Co.), but they are not limited to these. The concentration of such inorganic aqueous solutions may be appropriate, if it does not exceed saturation concentration. As other supplying method, inorganic salts may be directly added as they are in a powder state. The concentration at this time is not higher than saturation concentration.

Gelatin is used as protective colloid but natural high polymers besides gelatin and synthetic high polymers can also be used in the present invention. Alkali-processed gelatin, oxidized gelatin, i.e., gelatin in which a methionine group in the gelatin molecule is oxidized with hydrogen peroxide, etc. (a methionine content of 40 μmol/g or less), amino group-modified gelatin of the present invention (e.g., phthalated gelatin, trimellitated gelatin, succinated gelatin, maleated gelatin, and esterified gelatin), and low molecular weight gelatin (molecular weight of from 3,000 to 40,000) are used.

Further, natural high polymers are described in JP-B-7-111550 and *Research Disclosure*, Vol. 176, No. 17643, item IX (December, 1978).

Silver chloride {111} tabular grains or high silver chloride content {111} tabular grains for use in the present invention are disclosed in the following patents: U.S. Pat. Nos. 4,414,306, 4,400,463, 4,713,323, 4,783,398, 4,962,491, 4,983,508, 4,804,621, 5,389,509, 5,217,858 and 5,460,934.

High silver bromide content {111} tabular grains for use in the present invention are disclosed in the following patents: U.S. Pat. Nos. 4,425,425, 4,425,426, 4,439,520, 4,414,310, 4,433,048, 4,647,528, 4,665,012, 4,672,027, 4,678,745, 4,684,607, 4,593,964, 4,722,886, 4,755,617, 4,755,456, 4,806,461, 4,801,522, 4,835,322, 4,839,268, 4,914,014, 4,962,015, 4,977,074, 4,985,350, 5,061,609, 5,061,616, 5,068,173, 5,132,203, 5,272,048, 5,334,469, 5,334,495, 5,358,840 and 5,372,927.

{100} Tabular grains for use in the present invention are disclosed in the following patents: U.S. Pat. Nos. 4,386,156, 5,275,930, 5,292,632, 5,314,798, 5,320,938, 5,319,635, 5,356,764, European Patents 569971, 737887, JP-A-6-308648 and JP-A-9-5911.

As a method for making light absorption strength by a sensitizing dye per unit area of the silver halide grain surface 100 or more, but when the spectral sensitization maximum wavelength of the grain is 500 nm or less, light absorption strength of 60 or more, the following methods are particularly preferred.

(1) A method of increasing light absorption strength by increasing the adsorption amount of a dye is disclosed in Japanese Patent Application No. 8-348524. More preferred is a method in which the total addition amount of dyes represented by formulae (1) and (2) disclosed in Japanese Patent Application No. 8-348524 is equivalent to the amount of 160% of the saturation coating amount, and still more preferred is that addition amounts of dyes represented by formulae (1) and (2) are respectively equivalent to 80% or more of the saturation coating amounts, and particularly preferred is a method in which a dye represented by formula (1) is added in the amount equivalent to 100% of the saturation coating amount in the first place, then dyes represented by formulae (1) and (2) are added in the same amount and respectively equivalent to 30% or more of the saturation coating amounts.

(2) Methods of increasing light absorption strength not by increasing a dye adsorption amount, i.e., in the amount of 100% or less of a saturation coating amount, are disclosed in Japanese Patent Application No. 9-45024 and JP-A-10-142724. More preferred is a method of using a novel methine compound obtained by linking oxonol or merocyanine with cyanine as disclosed in Japanese Patent Application No. 9-45024 and a novel methine compound obtained by linking hemicyanines with each other or hemioxonols with each other as disclosed in JP-A-10-142724 respectively in the amounts equivalent to the amounts of from 70% to 100% of saturation coating amounts.

The saturation coating amount used in the present invention is the amount of a sensitizing dye which completely coats the grain surfaces of the emulsion taking the molecular occupancy area of the sensitizing dye as 80 $Å^2$.

When a silver halide photographic emulsion contains silver halide grains having light absorption strength of 100 or more (or light absorption strength of 60 or more when the grains have a spectral absorption maximum wavelength of 500 nm or less), it is preferred that ½ or more of the entire amount of silver halide grains contained in the emulsion be silver halide grains having light absorption strength of 100 or more (or light absorption strength of 60 or more when the grains have a spectral absorption maximum wavelength of 500 nm or less). Further, light absorption strength is preferably from 100 to 100,000, provided that light absorption strength of the grain having a spectral absorption maximum wavelength of 500 nm or less is preferably from 80 to 100,000, more preferably from 100 to 100,000. With respect to the grain having a spectral absorption maximum wavelength of 500 nm or less, the spectral absorption maximum wavelength is preferably 350 nm or more.

According to the kinds of photographic materials, as it is required to have strong absorption in a narrower wave number region, it is more preferred to select the kind of dyes so that 90% or more of light absorption strength is concentrated within the integrated range of from x $cm^{-1}$ to x+5,000 $cm^{-1}$ (where x is the value to make the above range of light absorption strength maximum, i.e., 5,000 $cm^{-1}$<x<30,000 $cm^{-1}$).

The light absorption strength per unit area of the grain surface can be obtained using a microspectrophotometer. A microspectrophotometer is a device which can measure the absorption spectrum of a minute area and the transmission spectrum of one grain can be measured. With respect to the measurement of the absorption spectrum of one grain by a microspectral method, Yamashita, et al., *A Summary of Lectures of Annual Meeting* of Nihon Shashin Gakkai, 1996, p. 15 can be referred to. The light absorption strength per one grain can be found from this absorption spectrum, but as the light transmitted through a grain is absorbed at two faces of upper and lower faces, the light absorption strength per unit area of the grain surface can be searched for as one half of the light absorption strength per one grain obtained by the above method.

For the inclusion of sensitizing dyes for use in the present invention in the silver halide photographic emulsion of the present invention, they may be directly dispersed in the emulsion, or they may be dissolved in water, a single or mixed solvent of methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, acetonitrile, tetrahydrofuran, N,N-dimethylformamide, etc., and then added to the emulsion.

In addition, various methods can be used for the inclusion of sensitizing dyes in the emulsion, for example, a method in which dyes are dissolved in a volatile organic solvent, the solution is dispersed in water or hydrophilic colloid and this dispersion is added to the emulsion as disclosed in U.S. Pat. No. 3,469,987, a method in which water-insoluble dyes are dispersed in a water-soluble solvent without being dissolved and this dispersion is added to the emulsion as disclosed in JP-B-46-24185, a method in which dyes are dissolved in acid and the solution is added to the emulsion, or dyes are added to the emulsion as an aqueous solution coexisting with acid or base as disclosed in JP-B-44-23389, JP-B-44-27555 and JP-B-57-22091, a method in which dyes are added to the emulsion as an aqueous solution or colloidal dispersion coexisting with a surfactant as disclosed in U.S. Pat. Nos. 3,822,135 and 4,006,025, a method in which dyes are directly dispersed in a hydrophilic colloid and the dispersion is added to the emulsion as disclosed in JP-A-53-102733 and JP-A-58-105141, or a method in which dyes are dissolved using a compound capable of red-shifting and the solution is added to the emulsion as disclosed in JP-A-51-74624 can be used.

Further, ultrasonic waves can also be used for dissolution.

The time of the addition of the sensitizing dyes for use in the present invention to the silver halide emulsion of the present invention may be at any stage of the preparation of the emulsion recognized as useful hitherto. They may be added at any time or in any stage if it is before coating of the emulsion, for example, before grain formation stage of silver halide grains or/and desalting stage, during desilvering stage and/or after desalting and before beginning of chemical ripening, as disclosed in U.S. Pat. Nos. 2,735,766, 3,628,960, 4,183,756, 4,225,666, JP-A-58-184142 and JP-A-60-196749, or immediately before or during chemical ripening, after chemical ripening and before coating of the emulsion as disclosed in JP-A-58-113920. Also, as disclosed in U.S. Pat. No. 4,225,666 and JP-A-58-7629, the sensitizing dyes can be used as a single compound alone or in combination with compounds having different structures, and they can be divided and added separately, for example, one part of them is added during grain formation stage and the remaining is added during chemical ripening or after the completion of chemical ripening, otherwise one part is added prior to chemical ripening or during chemical ripening stage and the remaining after completion of chemical ripening. The kinds of compounds added separately and combinations of compounds may be varied.

A silver halide emulsion is in general chemically sensitized before use. As chemical sensitization, chalcogen sensitization (sulfur sensitization, selenium sensitization, tellurium sensitization), noble metal sensitization (gold sensitization) and reduction sensitization are used alone or in combination.

In sulfur sensitization, labile sulfur compounds are used as a sensitizer. Labile sulfur compounds are disclosed in P. Glafkides, *Chimie et Physique Photographique*, 5th Ed., Paul Montel (1987) and *Research Disclosure*, Vol. 307, No. 307105. Examples of sulfur sensitizers include thiosulfates (e.g., hypo), thioureas (e.g., diphenylthiourea, triethylthiourea, N-ethyl-N'-(4-methyl-2-thiazolyl)thiourea, carboxymethyltrimethylthiourea), thioamides (e.g., thioacetamide), rhodanines (e.g., diethyl rhodanine, 5-benzylidene-N-ethyl rhodanine), phosphine sulfides (e.g., trimethylphosphine sulfide), thiohydantoins, 4-oxooxazolidine-2-thiones, dipolysulfides (e.g., dimorpholine disulfide, cystine, hexathiocanethione), mercapto compounds (e.g., cysteine), polythionate, and elemental sulfur. Active gelatins can also be used as a sulfur sensitizer.

In selenium sensitization, labile selenium compounds are used as a sensitizer. Labile selenium compounds are disclosed in JP-B-43-13489, JP-B-44-15748, JP-A-4-25832, JP-A-4-109240, JP-A-4-271341, and JP-A-5-40324. Examples of selenium sensitizers include colloidal metal selenium, selenoureas (e.g., N,N-dimethylselenourea, trifluoromethylcarbonyltrimethylselenourea, acetyltrimethylselenourea), selenoamides (e.g., selenoacetamide, N,N-diethylphenylselenoamide), phosphineselenides (e.g., triphenylphosphineselenide, pentafluorophenyltriphenylphosphineselenide), selenophosphates (e.g., tri-p-tolylselenophosphate, tri-n-butylselenophosphate), seleno ketones (e.g., selenobenzophenone), isoselenocyanates, selenocarboxylic acids, seleno esters, and diacylselenides. In addition, comparatively stable selenium compounds such as selenious acid, potassium selenocyanide, selenazoles and selenides (disclosed in JP-B-46-4553 and JP-B-52-34492) can also be used as a selenium sensitizer.

Labile tellurium compounds are used as a tellurium sensitizer in tellurium sensitization. Labile tellurium compounds are disclosed in Canadian Patent 800,958, British Patents 1,295,462, 1,396,696, JP-A-4-204640, JP-A-4-271341, JP-A-4-333043, and JP-A-5-303157. Examples of tellurium sensitizers include telluroureas (e.g., tetramethyltellurourea, N,N'-dimethylethylenetellurourea, N,N'-diphenylethylenetellurourea), phosphinetellurides (e.g., butyldiisopropylphosphinetelluride, tributylphosphinetelluride, tributoxyphosphinetelluride, ethoxydiphenylphosphinetelluride), diacyl(di)tellurides (e.g., bis(diphenylcarbamoyl)ditelluride, bis(N-phenyl-N-methylcarbamoyl)ditelluride, bis(N-phenyl-N-methylcarbamoyl)telluride, bis(ethoxycarbonyl)telluride), isotellurocyanatos, telluroamides, tellurohydrazides, telluro esters (e.g., butylhexyltelluro ester), telluro ketones (e.g., telluroacetophenone), colloidal tellurium, (di)tellurides, and other tellurium compounds (e.g., potassium telluride, sodium telluropentathionate).

In noble metal sensitization, noble metal salts of gold, platinum, palladium, and iridium are used as a sensitizer. Noble metal salts are disclosed in P. Glafkides, *Chimie et Physique Photographique*, 5th Ed., Paul Montel (1987) and *Research Disclosure*, Vol. 307, No. 307105. Gold sensitization is particularly preferred. As described above, the effect of the present invention is particularly exhibited in the mode of conducting gold sensitization.

There are disclosed in *Photographic Science and Engineering*, Vol. 19322 (1975) and *Journal of Imaging Science*, Vol. 3228 (1988) that gold can be removed from the sensitization speck on an emulsion grain using a solution containing potassium cyanide (KCN). According to these descriptions, a cyanogen ion makes a gold atom or a gold ion adsorbed onto a silver halide grain isolate as a cyanogen complex to hinder gold sensitization. The action of gold sensitization can be sufficiently obtained by suppressing the occurrence of cyanogen according to the present invention.

Examples of gold sensitizers include chloroauric acid, potassium chloroaurate, potassium aurithiocyanate, gold sulfide, and gold selenide, as well as gold compounds disclosed in U.S. Pat. Nos. 2,642,361, 5,049,484 and 5,049,485.

Reducing compounds are used as a sensitizer in reduction sensitization. Reducing compounds are disclosed in P. Glafkides, *Chimie et Physique Photographique*, 5th Ed., Paul Montel (1987), and *Research Disclosure*, Vol. 307, No. 307105. Examples of reducing compounds include aminoiminomethanesulfinic acid (thiourea dioxide), borane compounds (e.g., dimethylamineborane), hydrazine compounds (e.g., hydrazine, p-tolylhydrazine), polyamine compounds (e.g., diethylenetriamine, triethylenetetramine), stannous chloride, silane compounds, reductones (e.g., ascorbic acid), sulfite, aldehyde compounds, and hydrogen gas. Reduction sensitization can be carried out in the atmosphere of high pH and excessive silver ion (so-called silver ripening).

Chemical sensitization may be conducted in combination of two or more. A combination of chalcogen sensitization with gold sensitization is particularly preferred. Reduction sensitization is preferably conducted during silver halide grain formation. The use amount of a sensitizer is in general determined according to the kind of silver halide grains to be used and the conditions of chemical sensitization.

The use amount of a chalcogen sensitizer is generally from $10^{-8}$ to $10^{-2}$ mol, preferably from $10^{-7}$ to $5\times10^{-3}$ mol, per mol of the silver halide.

The use amount of a noble metal sensitizer is preferably from $10^{-7}$ to $10^{-2}$ mol per mol of the silver halide.

The conditions of chemical sensitization are not particularly limited. pAg is in general from 6 to 11, preferably from 7 to 10, pH is preferably from 4 to 10, and temperature is preferably from 40 to 95° C., and more preferably from 45 to 85° C.

Various compounds can be added to a silver halide emulsion for preventing generation of fog or stabilizing photographic capabilities during production, storage or processing of a photographic material. Examples of such compounds include azoles (e.g., benzothiazolium salt, nitroindazoles, triazoles, benzotriazoles, benzimidazoles (in particular, nitro- or halogen-substituted); heterocyclic mercapto compounds (e.g., mercaptothiazoles, mercaptobenzothiazoles, mercaptobenzimidazoles, mercaptothiadiazoles, mercaptotetrazoles (in particular, 1-phenyl-5-mercaptotetrazoles) mercaptopyrimidines); the above heterocyclic mercapto compounds having a water-soluble group such as a carboxyl group or a sulfone group; thioketo compounds (e.g., oxazolinethione); azaindenes (e.g., tetraazaindenes (in particular, 4-hydroxy-substituted-(1,3,3a,7)tetraazaindene)); benzenethiosulfonic acid; and benzenesulfinic acid. These compounds are in general known as antifoggants or stabilizers.

Antifoggants or stabilizers are, in general, added after chemical sensitization. However, they may be added during chemical sensitization or before start of chemical sensitization. That is, they can be added at any time during silver halide emulsion grain forming process, e.g., during addition of a silver salt solution, during the period after addition and before start of chemical sensitization, or during chemical sensitization (preferably within the time up to 50% from the start, more preferably within the time up to 20%).

Various color couplers can be used in the present invention, and specific examples are disclosed in the patents cited in the above *Research Disclosure*, No. 17643, VII-C to G and ibid., No. 307105, VII-C to G. Non-diffusible couplers having a hydrophobic group called a ballast group or polymerized couplers are preferably used. Couplers may be either 2-equivalent or 4-equivalent to the silver ion. Colored couplers which have the effect of correcting colors or couplers which release development inhibitors upon development reaction (so-called DIR couplers) may be contained. Further, colorless DIR coupling compounds which produce a colorless coupling reaction product and release a development inhibitor may be contained.

Examples of preferred cyan couplers for use in the present invention include, e.g., naphthol based couplers and phenol based couplers, and preferred are those disclosed in U.S. Pat. Nos. 2,369,929, 2,772,162, 2,801,171, 2,895,826, 3,446,622, 3,758,308, 3,772,002, 4,052,212, 4,126,396, 4,146,396, 4,228,233, 4,254,212, 4,296,199, 4,296,200, 4,327,173, 4,333,999, 4,334,011, 4,343,011, 4,427,767, 4,451,559, 4,690,889, 4,775,616, West German Patent Publication No. 3,329,729, EP-A-121365, EP-A-249453, and JP-A-61-42658.

As magenta couplers, imidazo[1,2-b]pyrazoles disclosed in U.S. Pat. No. 4,500,630 and pyrazolo[1,5-b][1,2,4] triazoles disclosed in U.S. Pat. No. 4,540,654 are particularly preferably used. Other preferred magenta couplers include pyrazolotriazole couplers in which a branched alkyl group is directly bonded to the 2-, 3- or 6-position of the pyrazolotriazole ring disclosed in JP-A-61-65245, pyrazoloazole couplers having a sulfonamido group in the molecule disclosed in JP-A-61-65246, pyrazoloazole couplers having an alkoxyphenylsulfonamido ballast group disclosed in JP-A-61-147254, and pyrazolotriazole couplers having an alkoxyl group or an aryloxy group at the 6-position disclosed in European Patents (Publication) 226849 and 294785, in addition, couplers disclosed in U.S. Pat. Nos. 3,061,432, 3,725,067, 4,310,619, 4,351,897, 4,556,630, European Patent 73636, JP-A-55-118034, JP-A-60-35730, JP-A-60-43659, JP-A-60-185951, JP-A-61-72238, WO 88/04795, *Research Disclosure*, No. 24220 and ibid. No. 24230 are more preferably used.

Preferred yellow couplers are those disclosed, for example, in U.S. Pat. Nos. 3,933,501, 3,973,968, 4,022,620, 4,248,961, 4,314,023, 4,326,024, 4,401,752, 4,511,649, EP-A-249473, JP-B-58-10739, British Patents 1,425,020, and 1,476,760, and the use of pivaloylacetanilide is more preferred.

The above-described couplers which can be preferably used in the present invention are the same as those disclosed in detail in JP-A-2-248945 as preferred couplers, and as specific examples of the above couplers which can preferably be used in the present invention, specific examples of couplers disclosed in JP-A-2-248945, pp. 22 to 29 can be cited.

Typical examples of polymerized dye-forming couplers are disclosed in U.S. Pat. Nos. 3,451,820, 4,080,211, 4,367,282, 4,409,320, 4,576,910, EP-A-341188 and British Patent 2,102,137 and they are more preferably used.

The couplers disclosed in U.S. Pat. No. 4,366,237, European Patent 96570, British Patent 2,125,570, and West German Patent Publication No. 3,234,533 are preferred as couplers the colored dyes of which have an appropriate diffusibility.

The preferred colored couplers for correcting the unnecessary absorption of colored dyes are disclosed in the patents described in *Research Disclosure*, No. 17643, item VII-G, ibid., No. 307105, item VII-G, U.S. Pat. Nos. 4,004,929, 4,138,258, 4,163,670, British Patent 1,146,368, and JP-B-57-39413. Moreover, it is also preferred to use couplers for correcting the unnecessary absorption of colored dyes by fluorescent dyes released upon coupling disclosed in U.S. Pat. No. 4,774,181, and couplers having a dye precursor group capable of forming a dye upon reacting with a developing agent as a releasable group disclosed in U.S. Pat. No. 4,777,120.

Compounds which release photographically useful residual groups upon coupling can also preferably be used in the present invention. The preferred DIR couplers which release development inhibitors are disclosed in the patents cited in the foregoing *Research Disclosure*, No. 17643, item VII-F, ibid., No. 307105, item VII-F, JP-A-57-151944, JP-A-57-154234, JP-A-60-184248, JP-A-63-37346, JP-A-63-37350, U.S. Pat. Nos. 4,248,962 and 4,782,012.

Couplers disclosed in JP-A-59-157638, JP-A-59-170840, British Patents 2,097,140, and 2,131,188 are preferred as couplers which imagewise release nucleating agents or development accelerators at the time of development. Further, compounds which release fogging agents, development accelerators, silver halide solvents, etc., upon oxidation reduction reaction with the oxidation products of developing agents disclosed in JP-A-60-107029, JP-A-60-252340, JP-A-1-44940 and JP-A-1-45687 are also preferred.

Other compounds which can be used in the photographic material of the present invention include competitive couplers disclosed in U.S. Pat. No. 4,130,427, multiequivalent couplers disclosed in U.S. Pat. Nos. 4,283,472, 4,338,393 and 4,310,618, DIR redox compound-releasing couplers, DIR coupler-releasing couplers, DIR coupler-releasing redox compounds or DIR redox-releasing redox compounds disclosed in JP-A-60-185950 and JP-A-62-24252, couplers which release dyes which restore colors after separation disclosed in EP-A-173302 and EP-A-313308, bleaching accelerator-releasing couplers disclosed in the patents cited in *Research Disclosure*, No. 11449, ibid., No. 24241 and JP-A-61-201247, ligand-releasing couplers disclosed in U.S. Pat. No. 4,553,477, leuco dye-releasing couplers disclosed in JP-A-63-75747, and fluorescent dye-releasing couplers disclosed in U.S. Pat. No. 4,774,181.

Two or more of the above couplers, etc., can be used in combination in the same layer for satisfying the characteristics required of the photographic material, or, of course, the same compound can be added to two or more different layers.

The above couplers are contained in a silver halide photographic emulsion layer which constitutes a light-sensitive layer generally in an amount of from 0.1 to 1.0 mol, preferably from 0.1 to 0.5 mol, per mol of the silver halide.

In the present invention, various known methods can be used to incorporate the above couplers into a light-sensitive layer. In general, an oil-in-water dispersing method known as an oil-protect method is effectively used for the addition. That is, the coupler is dissolved in a solvent, then dispersed in an aqueous solution of gelatin containing a surfactant. Alternatively, couplers may be added as oil-in-water dispersion accompanied by phase inversion by adding water or an aqueous solution of gelatin to a coupler solution containing a surfactant. In addition, alkali-soluble couplers can be dispersed according to a so-called Fischer dispersing method. After a low boiling point organic solvent is removed from the coupler dispersion by distillation, noodle washing or ultrafiltration, couplers may be mixed with a photographic emulsion.

As a dispersion medium of couplers, it is preferred to use a high boiling point organic solvent having a dielectric constant of from 2 to 20 at 25° C. and a refractive index of from 1.5 to 1.7 at 25° C. and/or a water-insoluble high molecular compound. Such solvents as disclosed in the above JP-A-2-248945, p. 30 are preferably used as a high boiling point organic solvent. Compounds which have a melting point of 100° C. or less, a boiling point of 140° C. or more, are immiscible with water, and are good solvents to couplers can be used. A melting point of a high boiling point organic solvent is preferably 80° C. or less and a boiling point is preferably 160° C. or more, more preferably 170° C. or more.

These high boiling point organic solvents are disclosed in detail in JP-A-62-215272, p. 137 right lower column to p. 144, right upper column.

These couplers can be dispersed in a hydrophilic colloidal aqueous solution in an emulsified state by impregnating in a loadable latex polymer (e.g., disclosed in U.S. Pat. No. 4,203,716) in the presence (or absence) of the above high boiling point organic solvents, or by dissolving in a polymer insoluble in water but soluble in an organic solvent. Homopolymers or copolymers disclosed in WO 88/00723, from pages 12 to 30 are preferably used as such polymers insoluble in water but soluble in an organic solvent, in particular, acrylamide based polymers ate preferred in view of dye image stability.

The following compounds are particularly preferably used in combination with the above couplers.

That is, the use of a compound which produces a chemically inactive and substantially colorless compound upon chemically bonding with an aromatic amine developing agent remaining after color development and/or a compound which produces a chemically inactive and substantially colorless compound upon chemically bonding with the oxidized product of an aromatic amine color developing agent remaining after color development, alone or in combination, is preferred for preventing the generation of stain due to the formation of a colored dye caused by the coupling reaction of the coupler with the color developing agent or the oxidized product thereof remaining in the film, or preventing other side reactions, during preservation after processing. Such compounds and desired conditions are disclosed in detail in JP-A-2-248945, pp. 31 and 32, and as preferred specific examples of the former, compounds disclosed in JP-A-63-158545, JP-A-62-283338, JP-A-64-2042, European Patents 277589 and 298321 can be mentioned, and as preferred specific examples of the latter, compounds disclosed in JP-A-62-143048, JP-A-62-229145, European Patent 255722, JP-A-64-2042, JP-A-1-57259, JP-A-1-230039, European Patents 277589 and 298321 can be cited. Further, combinations of the former and the latter are disclosed in European Patent 277589.

Silver halide emulsion layers and/or other hydrophilic colloid layers of the silver halide photographic material containing the emulsion according to the present invention may contain dyes for the purpose of increasing image sharpness and safelight safety or preventing color mixing. Such dyes may be added to the layer in which the emulsion is contained or not contained but are preferably fixed in a specific layer. For that purpose, dyes are included in colloid layers in a nondiffusible state and used so as to be decolored during the course of development processing. In the first place, a fine grain dispersion of a dye which is substantially insoluble in water having pH 7 and soluble in water of pH 7 or more is used. Secondly, an acidic dye is used together with a polymer or a polymer latex having a cation site. Dyes represented by formulae (VI) and (VII) disclosed in JP-A-63-197947 are useful in the first and second methods, in particular, the dye having a carboxyl group is effective in the first method.

It is preferred for the photographic material of the present invention to contain phenethyl alcohol and various antiseptics or biocides, e.g., 1,2-benzisothiazolin-3-one, n-butyl-p-hydroxybenzoate, phenol, 4-chloro-3,5-dimethylphenol, 2-phenoxyethanol, 2-(4-thiazolyl)benzimidazole, etc., disclosed in JP-A-62-272248, JP-A-63-257747 and JP-A-1-80941.

There is no particular limitation on other additives for use in the photographic material of the present invention and, for example, disclosures in *Research Disclosure*, Vol. 176, Item 17643 (RD 17643), ibid., Vol. 187, Item 18716 (RD 18716) and ibid., Vol. 308, Item 308119 (RD 308119) can be referred to.

The locations related to various additives in RD 17643, RD 18716 and RD 308119 are indicated in the following table.

| Type of Additives | RD 17643 | RD 18716 | RD 308119 |
|---|---|---|---|
| 1. Chemical Sensitizers | page 23 | page 648, right column | page 996 |
| 2. Sensitivity Increasing Agents | — | page 648, right column | — |

-continued

| Type of Additives | RD 17643 | RD 18716 | RD 308119 |
|---|---|---|---|
| 3. Spectral Sensitizers and Supersensitizers | pages 23–24 | page 648, right column to page 649, right column | page 996, right column to page 998 right column |
| 4. Brightening Agents | page 24 | — | page 998, right column |
| 5. Antifoggants and Stabilizers | pages 24–25 | page 649, right column | page 998, right column to page 1000, right column |
| 6. Light Absorbers, Filter Dyes, and Ultraviolet Absorbers | pages 25–26 | page 649, right column to page 650, left column | page 1003, left column to page 1003, right column |
| 7. Antistaining Agents | page 25, right column | page 650, left to right columns | page 1002, right column |
| 8. Dye image Stabilizers | page 25 | — | page 1002, right column |
| 9. Hardening Agents | page 26 | page 651, left column | page 1004, right column to page 1005, left column |
| 10. Binders | page 26 | page 651, left column | page 1003, right column to page 1004, right column |
| 11. Plasticizers and Lubricants | page 27 | page 650, right column | page 1006, left column to page 1006 right column |
| 12. Coating Aids and Surfactants | pages 26–27 | page 650, right column | page 1005, left column to page 1006, left column |
| 13. Antistatic Agents | page 27 | page 650, right column | page 1006, right column to page 1007, left column |
| 14. Matting Agents | — | — | page 1008, left column |

The photographic material of the present invention can be applied, for example, to black-and-white and color negative films for photographing (for general and cinematographic uses), color reversal films (for slide and cinematographic uses), black-and-white and color photographic papers, color positive films (for cinematographic use), color reversal photographic papers, black-and-white and color heat-developable photographic materials, black-and-white and color photographic materials for plate making (lith films and scanner films, etc.), black-and-white and color photographic materials for medical and industrial uses, black-and-white and color diffusion transfer photographic materials (DTR), etc., and particularly preferably used as color papers.

Proper supports which can be used in the present invention are disclosed, for example, in RD, No. 17643, p. 28, ibid., No. 18716, p. 647, right column to p. 648, left column, and ibid., No. 307105, p. 879.

In the photographic processing of photographic materials using the present invention, any known method can be used and any known processing solution can be used. The processing temperature is selected generally between 18° C. and 50° C. but temperatures lower than 18° C. or higher than 50° C. are available. According to purposes, both development processing for forming a silver image (black-and-white photographic processing) and color photographic processing comprising development processing for forming a dye image can be applied.

In a black-and-white developing solution, known developing agents such as dihydroxybenzenes (e.g., hydroquinone), 3-pyrazolidones (e.g., 1-phenyl-3-pyrazolidone), aminophenols (e.g., N-methyl-p-aminophenol) and the like can be used alone or in combination.

A color developing solution, in general, comprises an alkaline aqueous solution containing a color developing agent.

As a color developing agent, conventionally known aromatic primary amine color developing agents can be used, for example, phenylenediamines (e.g., 4-amino-N-diethylaniline, 4-amino-3-methyl-N,N-diethylaniline, 4-amino-N-ethyl-N-β-hydroxyethylaniline, 4-amino-3-methyl-N-ethyl-N-β-hydroxyethylaniline, 4-amino-3-methyl-N-ethyl-N-β-methanesulfonylaminoethylaniline, 4-amino-3-methyl-N-ethyl-N-β-methoxyethylaniline).

In addition to the above, those disclosed in L. F. A. Mason, *Photographic Processing Chemistry*, Focal Press, pp. 226 to 229 (1966), U.S. Pat. Nos. 2,193,015, 2,592,364, and JP-A-48-64933 may be used. A developing solution can contain a pH buffer such as alkali metal sulfite, carbonate, borate and phosphate, or a development inhibitor or an antifoggant such as bromide, iodide, and an organic antifoggant. A developing solution may also contain, if necessary, a hard water softener, a preservative such as hydroxylamine, an organic solvent such as benzyl alcohol and diethylene glycol, a development accelerator such as polyethylene glycol, quaternary ammonium salt, and amines, a dye-forming coupler, a competitive coupler, a fogging agent such as sodium boronhydride, an auxiliary developing agent such as 1-phenyl-3-pyrazolidone, a thickener, the polycarboxylic acid chelating agent disclosed in U.S. Pat. No. 4,083,723, or the antioxidant disclosed in West German Patent (OLS) No. 2,622,950.

When color photographic processing is conducted, a photographic material is generally bleaching processed after being color development processed. A bleaching process and a fixing process may be carried out at the same time or may be performed separately. Compounds of polyvalent metals such as iron(III), cobalt(III), chromium(IV), copper(II), etc., peracids, quinones, and nitroso compounds are used as a bleaching agent. For example, bleaching agents which can be used include a complex salt such as an organic complex salt of ferricyanide, bichromate, iron(III) or cobalt(III) with aminopolycarboxylic acids, e.g., ethylenediaminetetraacetic acid, nitrilotriacetic acid, and 1,3-diamino-2-propanoltetraacetic acid, or a complex salt of organic acid such as citric acid, tartaric acid, and malic acid, or persulfate, permanganate or nitrosophenol. The use of potassium ferricyanide, sodium ethylenediaminetetraacetic acid iron (III) complex salt and ammonium ethylenediaminetetraacetic acid iron(III) complex salt is preferred above all. Ethylenediaminetetraacetic acid iron(III) complex salt is useful in a bleaching solution or a monobath blixing solution.

A bleaching solution of a blixing solution can contain various additives as well as thiol compounds disclosed in U.S. Pat. Nos. 3,042,520, 3,241,966, JP-B-45-8506, and JP-B-45-8836. Further, the photographic material of the present invention may be subjected to washing process or may be processed with a stabilizing solution without employing a washing step after bleaching or blixing step.

The present invention is preferably applied to a silver halide photographic material having a transparent magnetic recording layer. The polyester laminar supports which have been previously heat-treated as disclosed in detail in JP-A-6-35118, JP-A-6-17528, and Hatsumei-Kyokai Kokai Giho No. 94-6023, e.g., polyethylene aromatic dicarboxylate based polyester supports, having a thickness of from 50 to 300 μm, preferably from 50 to 200 μm, more preferably from 80 to 115 μm, and particularly preferably from 85 to 105 μm, annealed at 40° C. or more and the glass transition point temperature or less for from 1 to 1,500 hours, are preferably used for silver halide photographic materials having a magnetic recording layer for use in the present invention. The above-described supports can be subjected to a surface treatment such as an ultraviolet irradiation treatment as disclosed in JP-B-43-2603, JP-B-43-2604 and JP-B-45-3828, a corona discharge treatment as disclosed in JP-B-48-5043 and JP-A-51-131576, and a glow discharge treatment as disclosed in JP-B-35-7578 and JP-B-46-43480, undercoated as disclosed in U.S. Pat. No. 5,326,689, provided with an underlayer as disclosed in U.S. Pat. No. 2,761,791, if necessary, and coated with ferromagnetic particles as disclosed in JP-A-59-23505, JP-A-4-195726 and JP-A-6-59357.

The above-described magnetic layer may be provided on a support in stripe as disclosed in JP-A-4-124642 and JP-A-4-124645.

Further , the supports are subjected to an antistatic treatment, if necessary, as disclosed in JP-A-4-62543, and finally silver halide photographic emulsion are coated. The silver halide photographic emulsions disclosed in JP-A-4-166932, JP-A-3-41436 and JP-A-3-41437 are used herein.

The photographic material to be produced in this way is preferably manufactured according to the manufacturing and controlling methods as disclosed in JP-B-4-86817 and manufacturing data are recorded according to the methods disclosed in JP-B-6-87146. Before or after that, according to the methods disclosed in JP-A-4-125560, the photographic material is cut to a film of a narrower width than that of a conventional 135 size film and two perforations are made on one side per a smaller format picture plane so as to match with the smaller format picture plane than the picture plane heretofore in use.

The thus-produced film can be loaded and used in the cartridge packages disclosed in JP-A-4-157459, the cartridge disclosed in FIG. 9 in Example of JP-A-5-210202, the film patrones disclosed in U.S. Pat. No. 4,221,479, or the cartridges disclosed in U.S. Pat. Nos. 4,834,306, 4,834,366, 5,226,613 and 4,846,418.

Film cartridges and film patrones of the type which can encase a film tip as disclosed in U.S. Pat. Nos. 4,848,693 and 5,317,355 are preferred in view of the light shielding capability.

Further, a cartridge which has a locking mechanism as disclosed in U.S. Pat. No. 5,296,886, a cartridge which has the displaying function of working conditions, and a cartridge which has the function of preventing double exposure as disclosed in U.S. Pat. No. 5,347,334 are preferred.

In addition, a cartridge by which a film can be easily loaded only by inserting a film into a cartridge as disclosed in JP-A-6-85128 may be used.

The thus-produced film cartridges can be used for various photographic pleasures such as photographing and development processing using the following cameras, developing machines, and laboratory devices according to purposes.

The functions of film cartridges (patrones) can be sufficiently demonstrated using, for example, the easily loadable camera disclosed in JP-A-6-8886 and JP-A-6-99908, the automatic winding type camera disclosed in JP-A-6-57398 and JP-A-6-101135, the camera capable of pulling out the film and exchanging for a different kind of film in the course of photographing disclosed in JP-A-6-205690, the camera which can magnetically record the information at photographing time such as panorama photographing, high vision photographing or general photographing (capable of magnetic recording which can set up the print aspect ratio) disclosed in JP-A-5-293138 and JP-A-5-283382, the camera having the function of preventing double exposure disclosed in JP-A-6-101194, and the camera having the displaying function of working conditions of a film and the like disclosed in JP-A-5-150577.

The thus-photographed films may be processed using the automatic processors disclosed in JP-A-6-222514 and JP-A-6-212545, the using methods of the magnetic recording information on the film disclosed in JP-A-6-95265 and JP-A-4-123054 may be used before, during or after processing, or the function of selecting the aspect ratio disclosed in JP-A-5-19364 can be used.

If development processing is motion picture type development, the film is processed by splicing according to the method disclosed in JP-A-5-119461.

Further, during and after development processing, the attachment and detachment disclosed in JP-A-6-148805 are conducted.

After processing has been conducted thus, the information on the film may be altered to a print through back printing and front printing to a color paper according to the methods disclosed in JP-A-2-184835, JP-A-4-186335 and JP-A-6-79968.

The film may be returned to a customer with the index print disclosed in JP-A-5-11353 and JP-A-5-232594 and the return cartridge.

The present invention will be described in further detail with reference to examples but the present invention should not be construed as being limited thereto.

EXAMPLE 1

Emulsion 1-A

Preparation of Extremely Thin Silver Iodobromide Tabular Grain Emulsion

Tabular grains were prepared as described below using the mixing chamber shown in FIG. 1 (capacity of the mixing chamber: 2 cc) according to the system shown in FIG. 2.

To a reaction vessel 1 were added 1.0 liter of water and 2 g of low molecular weight ossein gelatin (average molecular weight: 10,000) and dissolved, the solution was maintained at 35° C. Subsequently, 50 cc of a 0.6 M silver nitrate aqueous solution and 200 cc of a 0.16 M KBr aqueous solution containing 0.8 wt % of low molecular weight gelatin were added to a mixing chamber 7 over 2 minutes. The emulsion produced was continuously added to the reaction vessel over 2 minutes. The rotation speed of stirring of the mixing chamber was 2,000 rpm. (Nucleation)

Three hundred (300) cc of a solution containing oxidized 10% ossein gelatin (methionine content: 5 $\mu$mol/g) and KBr were added to the reaction vessel and pBr was adjusted to 2.1, followed by the increase of the temperature to 85° C. (Ripening)

Subsequently, 600 cc of a 1.0 M silver nitrate aqueous solution, 600 cc of a 0.98 M KBr aqueous solution containing 3 mol% of KI and 800 cc of an aqueous gelatin solution containing 5% low molecular weight gelatin were again added to the mixing chamber at accelerated flow rate (the final flow rate was 4 times of the initial flow rate). Fine grain emulsion formed in the mixing chamber was continuously added to the reaction vessel. The rotation speed of stirring of the mixing chamber was 2,000 rpm.

During grain growth, $8\times10^{-8}$ mol/mol Ag of $IrCl_6$ was added as a dope at the point when 70% of silver nitrate was added. Further, a yellow prussiate of potash solution was added to the mixing chamber before termination of grain growth. Yellow prussiate of potash was doped so as to 3% (in terms of the silver amount added) of the shell part of the grain became the local concentration of $3\times10^{-4}$ mol/mol Ag. After termination of the addition, the temperature of the emulsion was lowered to 35° C., the emulsion was washed according to an ordinary flocculation method, 70 g of lime-processed ossein gelatin was added and dissolved and pAg and pH were adjusted to 8.7 and 6.5, respectively. The thus-obtained Emulsion 1-A was stored in a cold dark room.

The obtained grains were extremely thin monodisperse tabular grains having an equivalent-circle diameter of 2.3 $\mu$m, an average thickness of 0.045 $\mu$m, an average aspect ratio of 51, and a variation coefficient of the equivalent-circle diameter of 16%. An equivalent-circle diameter represents a diameter of a circle when the projected area of a tabular grain is calculated in terms of a circle, and a variation coefficient is the value obtained by dividing the standard deviation of the equivalent-circle diameter by the average equivalent-circle diameter and multiplying 100.

Emulsion 1-B

Preparation of Silver Iodobromide Tabular Grain Emulsion

To a reaction vessel 1 were added 1.0 liter of water, 3 g of low molecular weight ossein gelatin (average molecular weight: 20,000) and 0.5 g of KBr and dissolved, the solution was maintained at 40° C. While stirring the solution, 10 cc of a 0.5 M silver nitrate solution and 20 cc of a 0.3 M KBr solution were added thereto over 40 seconds, followed by the addition of 22 cc of a 0.8 M KBr solution. The temperature was then raised to 75° C. and ripening was carried out for 5 minutes. Subsequently, 300 cc of an aqueous solution containing 10 wt % of lime-processed ossein gelatin was added to the reaction vessel. Then, 800 cc of a 1.5 M silver nitrate solution and 800 cc of a 1.5 M KBr solution containing 3 mol% of KI were added thereto. The temperature of the reaction vessel was maintained at 75° C.

During grain growth, $8\times10^{-8}$ mol/mol Ag of $IrCl_6$ was added as a dope at the point when 70% of silver nitrate was added. Further, a yellow prussiate of potash solution was added to the reaction vessel before termination of grain growth. Yellow prussiate of potash was doped so as to 3% (in terms of the silver amount added) of the shell part of the grain became the local concentration of $3\times10^{-4}$ mol/mol Ag. After termination of the addition, the temperature of the emulsion was lowered to 35° C., the emulsion was washed according to an ordinary flocculation method, 70 g of lime-processed ossein gelatin was added and dissolved and pAg and pH were adjusted to 8.7 and 6.5, respectively. The thus-obtained Emulsion 1-B was stored in a cold dark room.

The obtained grains were monodisperse tabular grains having an equivalent-circle diameter of 1.1 $\mu$m, an average thickness of 0.19 $\mu$m, an average aspect ratio of 6, and a variation coefficient of the equivalent-circle diameter of 15%.

Tabular grains of Emulsion 1-A and tabular grains of Emulsion 1-B have almost the same grain volume and the surface area per a grain of Emulsion 1-A was about 3.2 times as large as Emulsion 1-B.

The first dye shown in Table 1 was added to each of the above two emulsions in amount A and the emulsions were stirred at 40° C. for 10 minutes. The temperature of the emulsions was then increased to 60° C. The emulsions were added sodium thiosulfate, potassium chloroaurate and potassium thiocyanate and optimally sensitized. Further, the first dyes was added in amount B and stirred at 60° C. for 30 minutes, then the temperature was lowered to 40° C., and the second dye was added and stirred for 30 minutes.

TABLE 1

| | | First Dye | | | Second Dye | |
|---|---|---|---|---|---|---|
| Sample No. | Emulsion | Kind of Dye | Addition Amount A (mol/mol-Ag) | Addition Amount B (mol/mol-Ag) | Kind of Dye | Addition Amount (mol/mol-Ag) |
| Comparative Sample 11 | 1-B | H-1 | $7.0 \times 10^{-4}$ | $1.7 \times 10^{-4}$ | H-2 | $8.7 \times 10^{-4}$ |
| Comparative Sample 12 | 1-B | H-1 | $7.0 \times 10^{-4}$ | $1.7 \times 10^{-4}$ | H-1<br>H-2 | $4.4 \times 10^{-4}$<br>$4.4 \times 10^{-4}$ |
| Comparative Sample 13 | 1-B | S-1 | $7.0 \times 10^{-4}$ | $1.7 \times 10^{-4}$ | S-2 | $8.7 \times 10^{-4}$ |
| Comparative Sample 14 | 1-B | S-1 | $7.0 \times 10^{-4}$ | $1.7 \times 10^{-4}$ | S-1<br>S-2 | $4.4 \times 10^{-4}$<br>$4.4 \times 10^{-4}$ |
| Comparative Sample 15 | 1-B | S-1 | $2.3 \times 10^{-3}$ | $0.6 \times 10^{-3}$ | S-1<br>S-2 | $1.5 \times 10^{-3}$<br>$1.5 \times 10^{-3}$ |
| Comparative Sample 16 | 1-A | H-1 | $2.3 \times 10^{-3}$ | $0.6 \times 10^{-3}$ | H-2 | $2.9 \times 10^{-3}$ |
| Comparative Sample 17 | 1-A | H-1 | $2.3 \times 10^{-3}$ | $0.6 \times 10^{-3}$ | H-1<br>H-2 | $1.5 \times 10^{-3}$<br>$1.5 \times 10^{-3}$ |
| Invention 11 | 1-A | S-1 | $2.3 \times 10^{-3}$ | $0.6 \times 10^{-3}$ | S-2 | $2.9 \times 10^{-3}$ |
| Invention 12 | 1-A | S-1 | $2.3 \times 10^{-3}$ | $0.6 \times 10^{-3}$ | S-1<br>S-2 | $1.5 \times 10^{-3}$<br>$1.5 \times 10^{-3}$ |

H-1

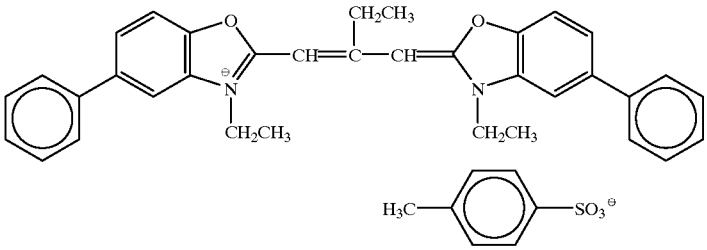

H-2

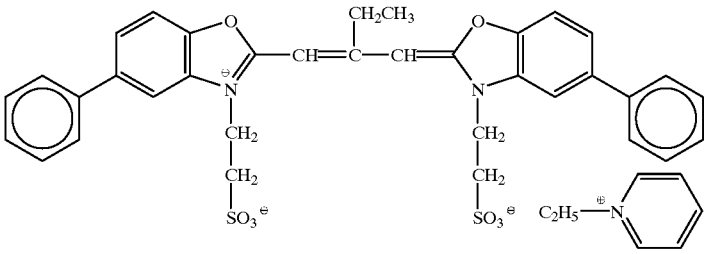

-continued

S-1

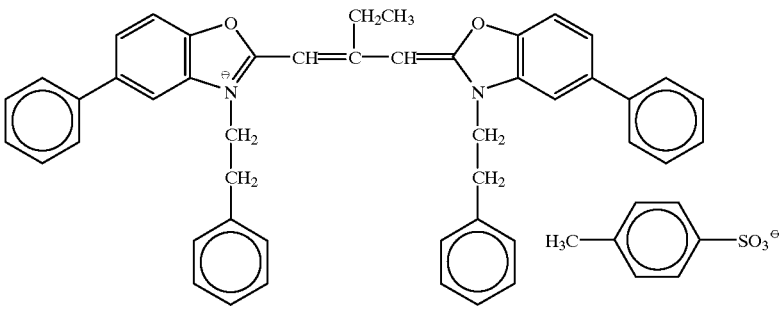

S-2

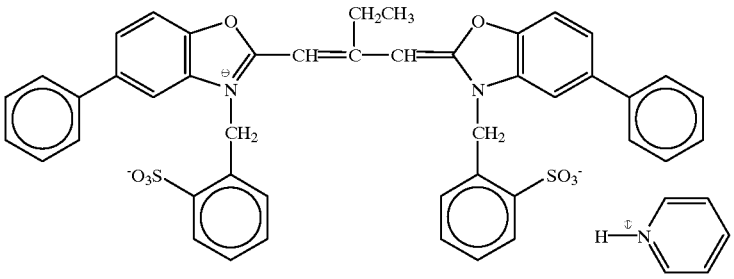

The measurement of the light absorption strength per unit area was conducted as follows: that is, the obtained emulsion was coated thinly on a slide glass and transmission spectrum and reflection spectrum of each grain were measured using a microspectrophotometer MSP 65 produced by Carl Zeiss Corp. according to the following method, from which absorption spectrum was searched for. A portion where grains were not present was taken as a reference of transmission spectrum and silicon carbide the reflectance of which was known was measured and the obtained value was made a reference of reflection spectrum. The measuring part was a circular aperture of a diameter of 1 $\mu$m, and transmission spectrum and reflection spectrum were measured in the wave number region of from 14,000 $cm^{-1}$ (714 nm) to 28,000 $cm^{-1}$ (357 nm) by adjusting the position so that the aperture part was not overlapped with the contour of the grain. Absorption spectrum was found taking 1−T (transmittance)−R (reflectance) as absorption factor A, one from which the absorption by silver halide was deducted was taken as absorption A'. The value obtained by integrating −Log (1-A') to wave number ($cm^{-1}$) was divided by 2 and this value was made the light absorption strength per unit surface area. The integrated region was from 14,000 $cm^{-1}$ to 28,000 $cm^{-1}$. A tungsten lamp was used as a light source and the light source voltage was 8 V. For minimizing the injury of a dye by irradiation of light, a primary monochromator was used, the distance of wavelength was 2 nm, and a slit width was 2.5 nm.

The emulsion and a protective layer were coated on a triacetate cellulose film support having an undercoat layer on the following condition to prepare a coated sample.

Condition of Emulsion Coating (1) Emulsion Layer

Emulsion: various emulsions ($3.6\times10^{-2}$ mol/$m^2$ as Ag)

The following coupler ($1.5\times10^{-3}$ mol/$m^2$)

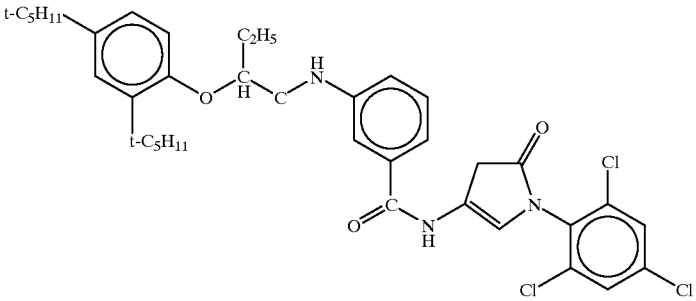

Tricresyl phosphate (1.10 g/$m^2$)

Gelatin (2.30 g/$m^2$)

(2) Protective Layer

Sodium 2,4-dichloro-6-hydroxy-s-triazine (0.08 g/$m^2$)

Gelatin (1.80 g/$m^2$)

Each of the samples prepared was allowed to stand under the condition of 40° C. and 70% RH for 14 hours, then subjected to exposure for 1/100 sec. through a green filter and continuous wedge, and color development processed as follows.

Color Development

| Step | Processing Time | Processing Temperature (° C.) |
|---|---|---|
| Color Development | 2 min 00 sec | 40 |
| Blixing | 3 min 00 sec | 40 |
| Washing (1) | 20 sec | 35 |
| Washing (2) | 20 sec | 35 |
| Stabilization | 20 sec | 35 |
| Drying | 50 sec | 65 |

The composition of each processing solution used is shown below.

| Color Developing Solution | |
|---|---|
| Diethylenetriaminepentaacetic Acid | 2.0 g |
| 1-Hydroxyethylidene-1,1-disulfonic Acid Sodium Sulfite | 4.0 g |
| Potassium Carbonate | 30.0 g |
| Potassium Bromide | 1.4 g |
| Potassium Iodide | 1.5 mg |
| Hydroxylamine Sulfate | 2.4 g |
| 4-(N-Ethyl-N-β-hydroxyethylamino)-2-methylaniline Sulfate | 4.5 g |
| Water to make | 1.0 l |
| pH | 10.05 |
| **Blixing Solution** | |
| Ammonium Ethylenediaminetetraacetato Ferrate Dihydrate | 90.0 g |
| Disodium Ethylenediaminetetraacetate | 5.0 g |
| Sodium Sulfite | 12.0 g |
| Aqueous Solution of Ammonium Thiosulfate (70%) | 260.0 ml |
| Acetic Acid (98%) | 5.0 ml |
| The following bleach accelerating agent | 0.01 mol |
| **Bleach Accelerating Agent** | |

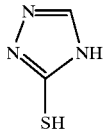

| | |
|---|---|
| Water to make | 1.0 l |
| pH | 6.0 |

Washing Water

City water was passed through a mixed bed column packed with an H-type cation exchange resin (Amberlite IR-120B of Rohm & Haas) and an OH-type anion exchange resin (Amberlite IR-400 of Rohm & Haas) and treated so as to reduce the calcium ion and magnesium ion concentrations to 3 mg/liter or less, subsequently 20 mg/liter of sodium isocyanurate dichloride and 1.5 g/liter of sodium sulfate were added thereto.

The pH of this washing water was in the range of from 6.5 to 7.5.

| Stabilizing Solution | |
|---|---|
| Formalin (37%) | 2.0 ml |
| Polyoxyethylene-p-monononylphenyl Ether (polymerization degree: 10) | 0.3 mg |

-continued

| Stabilizing Solution | |
|---|---|
| Disodium Ethylenediaminetetraacetate | 0.05 mg |
| Water to make | 1.0 l |
| pH | 5.0 to 8.0 |

Optical density of the development processed film was measured using a Fuji automatic densitometer. Sensitivity was a reciprocal of exposure amount required to give an optical density of fog+0.2 and represented by lux·second. The sensitivity was expressed as a relative value taking Comparative Sample 11 as a control, with fog being the density at the unexposed part.

The results obtained are shown in Table 2 below. As is shown in Table 2, using the dye addition method according to the present invention, multilayer adsorption of the dye onto the grain surface became feasible and the light absorption strength per unit area of a grain surface (½ of the light absorption strength of one grain) was conspicuously increased. Sensitivity increases when the light absorption strength increases, and the tabular silver halide emulsions having a high aspect ratio according to the present invention exhibited more conspicuous sensitization.

TABLE 2

| Coated Sample No. | Light Absorption Strength per Unit Area | Sensitivity |
|---|---|---|
| Comparative Sample 11 | 81 | 100 (control) |
| Comparative Sample 12 | 82 | 97 |
| Comparative Sample 13 | 142 | 144 |
| Comparative Sample 14 | 141 | 143 |
| Comparative Sample 15 | 409 | 128 |
| Comparative Sample 16 | 79 | 230 |
| Comparative Sample 17 | 77 | 226 |
| Invention 11 | 139 | 399 |
| Invention 12 | 157 | 451 |

EXAMPLE 2

The dyes shown Table 3 below were added to Emulsions 1-A and 1-B in Example 1 and each emulsion was stirred at 40° C. for 10 minutes. Then, the temperature of the emulsion was raised to 60° C. Sodium thiosulfate, potassium chloroaurate and potassium thiocyanate were added to each emulsion and the emulsion was optimally sensitized.

TABLE 3

| Sample No. | Emulsion | Kind of Dye | Addition Amount (mol/mol-Ag) |
|---|---|---|---|
| Comparative Sample 21 | 1-B | H-3 | $7.4 \times 10^{-4}$ |
| Comparative Sample 22 | 1-B | H-3<br>H-4 | $7.4 \times 10^{-4}$<br>$7.4 \times 10^{-4}$ |
| Comparative Sample 23 | 1-B | S-3 | $7.4 \times 10^{-4}$ |
| Comparative Sample 24 | 1-B | S-3 | $2.5 \times 10^{-3}$ |
| Comparative | 1-A | H-3 | $2.5 \times 10^{-3}$ |

TABLE 3-continued

| Sample No. | Emulsion | Kind of Dye | Addition Amount (mol/mol-Ag) |
|---|---|---|---|
| Sample 25 | | | |
| Comparative | 1-A | H-3 | $2.5 \times 10^{-3}$ |
| Sample 26 | | H-4 | $2.5 \times 10^{-3}$ |
| Invention 21 | 1-A | S-3 | $2.5 \times 10^{-3}$ |
| Comparative | 1-B | H-5 | $7.4 \times 10^{-4}$ |
| Sample 27 | | | |
| Comparative | 1-B | H-5 | $7.4 \times 10^{-4}$ |
| Sample 28 | | H-6 | $7.4 \times 10^{-4}$ |
| Comparative | 1-B | S-4 | $7.4 \times 10^{-4}$ |

TABLE 3-continued

| Sample No. | Emulsion | Kind of Dye | Addition Amount (mol/mol-Ag) |
|---|---|---|---|
| Sample 29 | | | |
| Comparative | 1-B | S-4 | $2.5 \times 10^{-3}$ |
| Sample 2A | | | |
| Comparative | 1-A | H-5 | $2.5 \times 10^{-3}$ |
| Sample 2B | | | |
| Comparative | 1-A | H-5 | $2.5 \times 10^{-3}$ |
| Sample 2C | | H-6 | $2.5 \times 10^{-3}$ |
| Invention 22 | 1-A | S-4 | $2.5 \times 10^{-3}$ |

H-3

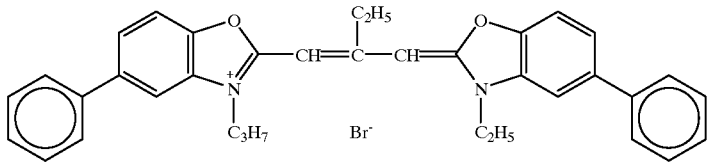

H-4

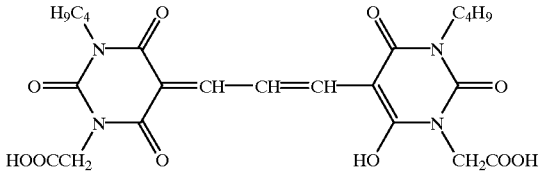

H-5

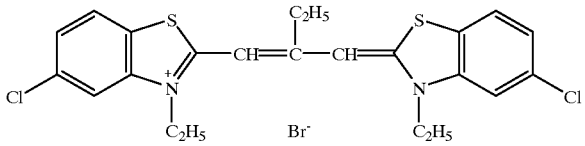

H-6

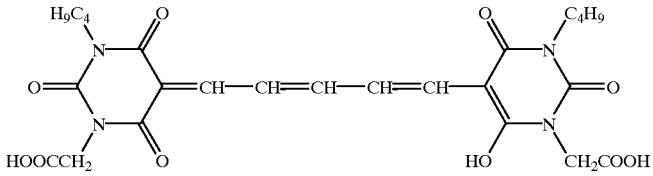

S-3

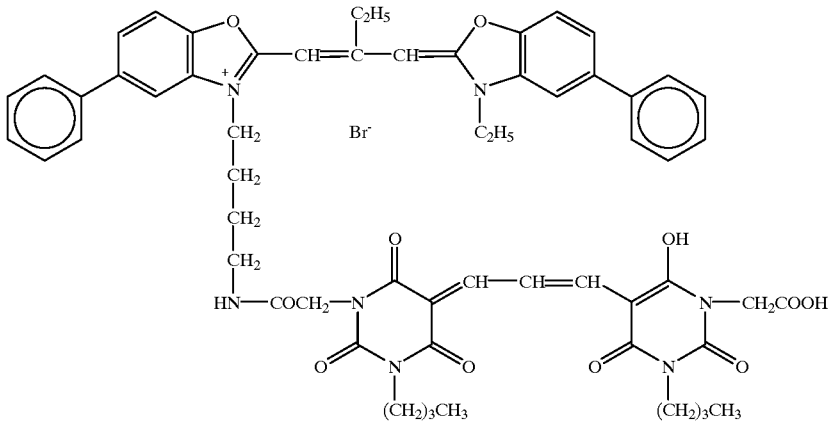

-continued

S-4

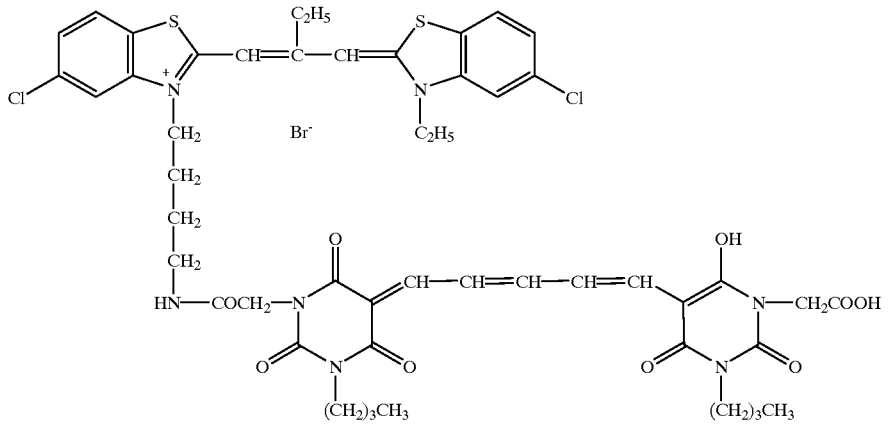

The emulsion and the protective layer were coated in the same manner as in Example 1 to prepare a coated sample.

Each of the samples prepared was allowed to stand under the condition of 40° C. and 70% RH for 14 hours, then Comparative Samples 21, 22, 23, 24, 25, 26 and Sample 21 of the invention were subjected to exposure for 1/100 sec. through a green filter and continuous wedge, Comparative Samples 27, 28, 29, 2A, 2B, 2C and Sample 22 of the invention were subjected to exposure for 1/100 sec. through a red filter and continuous wedge, and color development processed in the same manner as in Example 1.

Optical density of the development processed film was measured using a Fuji automatic densitometer. Sensitivity was a reciprocal of exposure amount required to give an optical density of fog+0.2 and represented by lux·second. The sensitivity was expressed as a relative value taking Comparative Samples 21 and 27 as a control, with fog being the density at the unexposed part.

The results obtained are shown in Table 4 below. As is shown in Table 4, using the linked dyes according to the present invention, the light absorption strength per unit area of a grain surface (½ of the light absorption strength of one grain) was conspicuously increased. Sensitivity increases when the light absorption strength increases, and the tabular silver halide emulsions having a high aspect ratio according to the present invention exhibited more conspicuous sensitization.

TABLE 4

| Coated Sample No. | Light Absorption Strength per Unit Area | Sensitivity |
|---|---|---|
| Comparative Sample 21 | 70 | 100 (control) |
| Comparative Sample 22 | 69 | 89 |
| Comparative Sample 23 | 117 | 121 |
| Comparative Sample 24 | 129 | 82 |
| Comparative Sample 25 | 69 | 229 |
| Comparative Sample 26 | 70 | 199 |
| Invention 21 | 119 | 302 |
| Comparative Sample 27 | 78 | 100 (control) |
| Comparative Sample 28 | 79 | 93 |
| Comparative Sample 29 | 131 | 128 |
| Comparative Sample 2A | 143 | 87 |
| Comparative Sample 2B | 76 | 233 |
| Comparative Sample 2C | 78 | 214 |
| Invention 22 | 132 | 315 |

EXAMPLE 3

Emulsion 3-A

Preparation of High Aspect Ratio Silver Chloride {111} Tabular Grain Emulsion Three point eight (3.8) grams of sodium chloride, 3.05 mmol of the compound shown below and 10 g of lime-processed ossein gelatin were added to 1.7 liters of water, and 28.8 cc of a silver nitrate aqueous solution (silver nitrate: 7.34 g) and 28.8 cc of a sodium chloride aqueous solution (sodium chloride: 2.71 g) were added by a double jet method, with stirring, to the vessel maintained at 35° C. over 1 minute. Two minutes after completion of addition, 188 g of a 10 wt % aqueous solution of trimellite gelatin which was obtained by trimellitating lime-processed ossein gelatin (trimellitation rate: 98%) was added to the reaction system and the temperature of the reaction vessel was raised to 75° C. over 15 minutes. Ripening was carried out at 75° C. for 12 minutes, then the temperature was lowered to 60° C. Subsequently, 480 cc of a silver nitrate aqueous solution (silver nitrate: 122.7 g) and a sodium chloride aqueous solution were added at accelerated flow rate for 60 minutes with maintaining the potential during addition of +100 mV to a saturated calomel electrode.

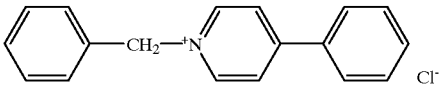

After completion of addition, the temperature was lowered to 40° C., an aqueous solution containing an anion precipitant was added to make the total amount 3 liters, then the pH was lowered using a sulfuric acid until the emulsion precipitated and the precipitate was washed with water.

After termination of washing, 80 g of line-processed gelatin, 85 cc of phenol (5%) and 242 cc of distilled water were added to the emulsion, dissolved, dispersed, and the pH and pAg were adjusted to 6.2 and 7.5, respectively. The obtained tabular grains had an average equivalent-circle diameter of 1.7 μm, an average thickness of 0.12 μm, and an average aspect ratio of 14.

Emulsion 3-B

Preparation of Low Aspect Ratio Silver Chloride {111} Tabular Grain Emulsion

Three point eight (3.8) grams of sodium chloride, 1.5 mmol of the foregoing compound and 10 g of lime-processed ossein gelatin were added to 1.7 liters of water, and 28.8 cc of a silver nitrate aqueous solution (silver nitrate: 7.34 g) and 28.8 cc of a sodium chloride aqueous solution (sodium chloride: 2.71 g) were added by a double jet method, with stirring, to the vessel maintained at 35° C. over 1 minute. Two minutes after completion of addition, 188 g of a 10 wt % aqueous solution of lime-processed ossein gelatin was added to the reaction system and the temperature of the reaction vessel was raised to 75° C. over 15 minutes. Ripening was carried out at 75° C. for 12 minutes. Subsequently, 480 cc of a silver nitrate aqueous solution (silver nitrate: 122.7 g) and a sodium chloride aqueous solution were added at accelerated flow rate for 39 minutes with maintaining the potential during addition of +150 mV to a saturated calomel electrode.

After completion of addition, the temperature was lowered to 40° C., an aqueous solution containing an anion precipitant was added to make the total amount 3 liters, then the pH was lowered using a sulfuric acid until the emulsion precipitated and the precipitate was washed with water.

After termination of washing, 80 g of line-processed gelatin, 85 cc of phenol (5%) and 242 cc of distilled water were added to the emulsion, dissolved, dispersed, and the pH and pAg were adjusted to 6.2 and 7.5, respectively. The obtained tabular grains had an average equivalent-circle diameter of 1.2 μm, an average thickness of 0.24 μm, and an average aspect ratio of 5.

Each of the above two emulsions were chemically sensitized at 60° C. with stirring. In the first place, 0.01 mol per mol of silver chloride of pure silver bromide fine grains having an equivalent-sphere diameter of 0.05 μm was added. After 10 minutes, the first dye shown in Table 5 was added to each of the above two emulsions in amount A, and the emulsion as optimally chemically sensitized by adding sodium thiosulfate and chloroauric acid. Further, the first dyes was added in amount B and the emulsion was stirred at 60° C. for 30 minutes, then the temperature was lowered to 40° C., and the second dye was added and stirred for 30 minutes.

TABLE 5

| | | First Dye | | | Second Dye | |
|---|---|---|---|---|---|---|
| Sample No. | Emulsion | Kind of Dye | Addition Amount A (mol/mol-Ag) | Addition Amount B (mol/mol-Ag) | Kind of Dye | Addition Amount (mol/mol-Ag) |
| Comparative Sample 31 | 3-B | H-7 | $5.0 \times 10^{-4}$ | $1.3 \times 10^{-4}$ | H-8 | $6.3 \times 10^{-4}$ |
| Comparative Sample 32 | 3-B | H-7 | $5.0 \times 10^{-4}$ | $1.3 \times 10^{-4}$ | H-7<br>H-8 | $3.2 \times 10^{-4}$<br>$3.2 \times 10^{-4}$ |
| Comparative Sample 33 | 3-B | S-5 | $5.0 \times 10^{-4}$ | $1.3 \times 10^{-4}$ | S-6 | $6.3 \times 10^{-4}$ |
| Comparative Sample 34 | 3-B | S-5 | $5.0 \times 10^{-4}$ | $1.3 \times 10^{-4}$ | S-5<br>S-6 | $3.2 \times 10^{-4}$<br>$3.2 \times 10^{-4}$ |
| Comparative Sample 35 | 3-B | S-5 | $8.2 \times 10^{-4}$ | $2.0 \times 10^{-4}$ | S-5<br>S-6 | $5.1 \times 10^{-4}$<br>$5.1 \times 10^{-4}$ |
| Comparative Sample 36 | 3-A | H-7 | $8.2 \times 10^{-4}$ | $2.0 \times 10^{-4}$ | H-8 | $1.0 \times 10^{-3}$ |
| Comparative Sample 37 | 3-A | H-7 | $8.2 \times 10^{-4}$ | $2.0 \times 10^{-4}$ | H-7<br>H-8 | $5.1 \times 10^{-4}$<br>$5.1 \times 10^{-4}$ |
| Invention 31 | 3-A | S-5 | $8.2 \times 10^{-4}$ | $2.0 \times 10^{-4}$ | S-6 | $1.0 \times 10^{-3}$ |
| Invention 32 | 3-A | S-5 | $8.2 \times 10^{-4}$ | $2.0 \times 10^{-4}$ | S-5<br>S-6 | $5.1 \times 10^{-4}$<br>$5.1 \times 10^{-4}$ |

H-7

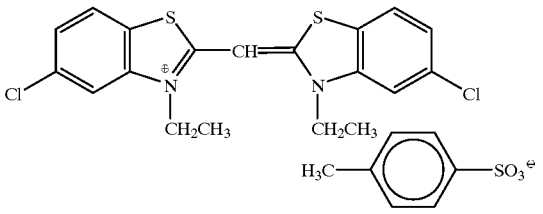

H-8

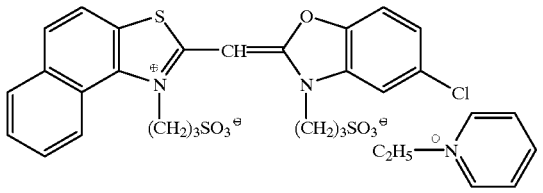

S-5

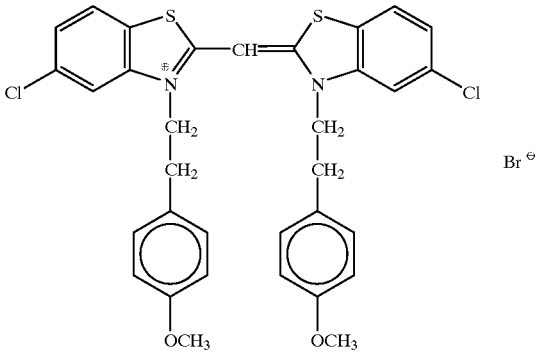

S-6

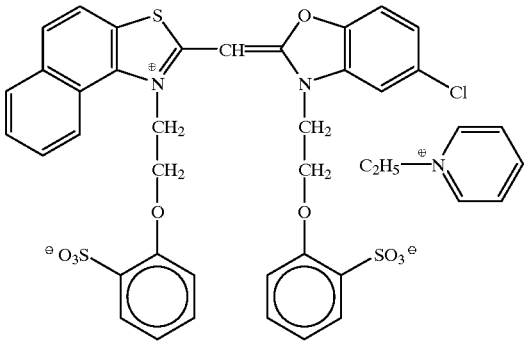

Preparation of Coated Sample

The following components were added to 1,307 g each of various emulsions (containing 1 mol of silver) chemically sensitized to prepare a coating solution.

| | |
|---|---|
| 14% Aq. soln. of inert gelatin | 756 g |
| Sodium salt of 1-(3-sulfophenyl)-5-mercapto-tetrazole | 0.129 g |
| Sodium dodecylbenzenesulfonate | 1.44 g |
| Sodium polystyrenesulfonate (average molecular weight: 600,000) | 1.44 g |
| $H_2O$ to make | 4,860 cc |

The emulsion coating solution and a surface protective layer coating solution were coated by simultaneous extrusion coating on a triacetate cellulose film support having an undercoat layer so as to obtain the coating amount of silver of 1.60 g/m$^2$ to prepare a coated sample.

Evaluation of Photographic Properties

Each coated sample was exposed to a light source of color temperature of 2,854°K for 1 second through a filter which transmits light of wavelength of 420 nm or longer. The exposed sample was development processed at 20° C. for 5 minutes with the following developing solution D19, fixed for 30 seconds with a fixing solution, Super Fuji Fix, manufactured by Fuji Photo Film Co., Ltd., washed with water, and dried.

| D19 Developing Solution | |
|---|---|
| Metol | 2.2 g |
| $Na_2SO_3$ | 96 g |
| Hydroquinone | 8.8 g |
| $NaCO_2.H_2O$ | 56 g |
| KBr | 5 g |
| $H_2O$ to make | 1,000 cc |

Optical density of the development processed film was measured using a Fuji automatic densitometer. Sensitivity was a reciprocal of exposure amount required to give an optical density of fog+0.2 and represented by lux·second. The sensitivity was expressed as a relative value taking Comparative Sample 31 as a control, with fog being the density at the unexposed part.

The results obtained are shown in Table 6 below. As is shown in Table 6, using the dye addition method according to the present invention, multilayer adsorption of the dye onto the grain surface became feasible and the light absorption strength per unit area of a grain surface (½ of the light absorption strength of one grain) was conspicuously increased. Sensitivity increases when the light absorption strength increases, and the tabular silver halide emulsions having a high aspect ratio according to the present invention exhibited more conspicuous sensitization.

TABLE 6

| Coated Sample No. | Light Absorption Strength per Unit Area | Sensitivity |
|---|---|---|
| Comparative Sample 31 | 49 | 100 (control) |
| Comparative Sample 32 | 48 | 98 |
| Comparative Sample 33 | 81 | 141 |
| Comparative Sample 34 | 82 | 142 |
| Comparative Sample 35 | 135 | 143 |
| Comparative Sample 36 | 50 | 159 |
| Comparative Sample 37 | 48 | 160 |
| Invention 31 | 89 | 255 |
| Invention 32 | 97 | 287 |

EXAMPLE 4

Emulsions 3-A and 3-B in Example 3 were chemically sensitized at 60° C. with stirring. In the first place, 0.01 mol per mol of silver chloride of pure silver bromide fine grains having an equivalent-sphere diameter of 0.05 μm was added. After 10 minutes, the sensitizing dye shown in Table 7 was added and each emulsion was optimally chemically sensitized by adding sodium thiosulfate and chloroauric acid.

TABLE 7

| Sample No. | Emulsion | Kind of Dye | Addition Amount (mol/mol-Ag) |
|---|---|---|---|
| Comparative Sample 41 | 3-B | H-9 | $5.4 \times 10^{-4}$ |
| Comparative Sample 42 | 3-B | S-7 | $5.4 \times 10^{-4}$ |
| Comparative Sample 43 | 3-B | S-7 | $8.9 \times 10^{-4}$ |
| Comparative Sample 44 | 3-A | H-9 | $8.9 \times 10^{-4}$ |
| Invention 41 | 3-A | S-7 | $8.9 \times 10^{-4}$ |

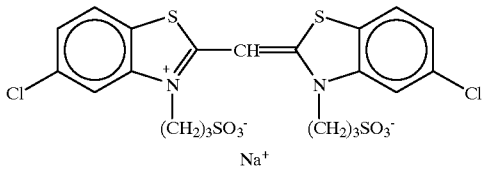

S-7

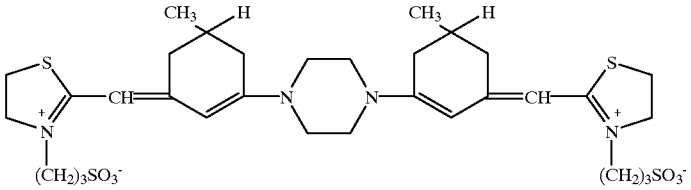

The emulsion and the protective layer was coated in the same manner as in Example 3 and a coated sample was prepared. Each of these samples was subjected to exposure in the same manner as in Example 3.

Optical density of the development processed film was measured using a Fuji automatic densitometer. Sensitivity was a reciprocal of exposure amount required to give an optical density of fog+0.2 and represented by lux·second. The sensitivity was expressed as a relative value taking Comparative Sample 41 as a control, with fog being the density at the unexposed part.

The results obtained are shown in Table 8 below. As is shown in Table 8, using the dye addition method according to the present invention, multilayer adsorption of the dye onto the grain surface became feasible and the light absorption strength per unit area of a grain surface (½ of the light absorption strength of one grain) was conspicuously increased. Sensitivity increases when the light absorption strength increases, and the tabular silver halide emulsions having a high aspect ratio according to the present invention exhibited more conspicuous sensitization.

TABLE 8

| Coated Sample No. | Light Absorption Strength per Unit Area | Sensitivity |
|---|---|---|
| Comparative Sample 41 | 43 | 100 (control) |
| Comparative Sample 42 | 62 | 121 |
| Comparative Sample 43 | 63 | 116 |
| Comparative Sample 44 | 42 | 155 |
| Invention 41 | 63 | 220 |

According to the present invention, a photographic material of high sensitivity can be obtained.

While the invention has been described in detail and with reference to specific examples thereof, it will be apparent to one skilled in the art that various changes and modifications can be made therein without departing from the spirit and scope thereof.

What is claimed is:

1. A silver halide photographic material having at least one silver halide emulsion layer containing a silver halide photographic emulsion, wherein said silver halide photographic emulsion comprises spectrally sensitized tabular silver halide grains having an average aspect ratio of from 8 to 100, and having light absorption strength by a sensitizing dye per unit surface area of the grain surface of 100 or more; wherein the light absorption strength by a sensitizing dye per unit surface area is defined as the value obtained by integrating optical density Log $[I_0/(I_0-I)]$ to wave number ($cm^{-1}$), taking the incident light amount on the unit surface area of the grain as $I_0$ and the light amount absorbed by the sensitizing dye on the surface as I, and the region of integration is from 5,000 $cm^{-1}$ to 35,000 $cm^{-1}$.

2. A silver halide photographic material having at least one silver halide emulsion layer containing a silver halide photographic emulsion, wherein said silver halide photographic emulsion comprises tabular silver halide grains spectrally sensitized at spectral absorption maximum wavelength of 500 nm or less having an average aspect ratio of from 8 to 100, and having light absorption strength by a sensitizing dye per unit surface area of the grain surface of 60 or more and less than 100; wherein the light absorption strength by a sensitizing dye per unit surface area is defined as the value obtained by integrating optical density Log $[I_0/(I_0-I)]$ to wave number ($cm^{-1}$), taking the incident light amount on the unit surface area of the grain as $I_0$ and the light amount absorbed by the sensitizing dye on the surface as I, and the region of integration is from 5,000 $cm^{-1}$ to 35,000 $cm^{-1}$.

3. The silver halide photographic material as claimed in claim 1, wherein said silver halide photographic emulsion is a tabular grain emulsion prepared by the method comprising:

supplying as addition solutions a water-soluble silver salt aqueous solution and a water-soluble halide aqueous solution to a mixing chamber installed outside a reaction vessel where at least one of a nucleation process and a grain growing process is carried out, and mixing the solutions to form silver halide fine grains, and immediately supplying said silver halide fine grains to said reaction vessel and at least one of nucleation and grain growth of silver halide grains is conducted in said reaction vessel.

4. The silver halide photographic material as claimed in claim 2, wherein said silver halide photographic emulsion is a tabular grain emulsion prepared by the method comprising:

supplying as addition solutions a water-soluble silver salt aqueous solution and a water-soluble halide aqueous solution to a mixing chamber installed outside a reaction vessel where at least one of a nucleation process and a grain growing process is carried out, and mixing the solutions to form silver halide fine grains, and immediately supplying said silver halide fine grains to said reaction vessel and at least one of nucleation and grain growth of silver halide grains is conducted in said reaction vessel.

5. The silver halide photographic material as claimed in claim 3, wherein said mixing chamber comprises:

a closed stirring tank equipped with a prescribed number of solution supply ports for supplying said addition solutions to be subjected to stirring and a solution exhaust port for exhausting silver halide fine grains which are formed by the completion of the stirring process, and stirring means for controlling the stirring condition of the mixture of aqueous solutions supplied by rotation driving at least one pair of stirring blades not having a rotary shaft protruding the wall of said stirring tank.

6. The silver halide photographic material as claimed in claim 4, wherein said mixing chamber comprises:

a closed stirring tank equipped with a prescribed number of solution supply ports for supplying said addition solutions to be subjected to stirring and a solution exhaust port for exhausting silver halide fine grains which are formed by the completion of the stirring process, and stirring means for controlling the stirring condition of the mixture of aqueous solutions supplied by rotation driving at least one pair of stirring blades not having a rotary shaft protruding the wall of said stirring tank.

7. The silver halide photographic material as claimed in claim 1, wherein said silver halide photographic emulsion contains a silver halide emulsion prepared in the presence of gelatin to which at least one carboxyl group (a —COOH group) is newly introduced when the amino group (an —$NH_2$ group) in gelatin is chemically modified.

8. The silver halide photographic material as claimed in claim 2, wherein said silver halide photographic emulsion contains a silver halide emulsion prepared in the presence of gelatin to which at least one carboxyl group (a —COOH group) is newly introduced when the amino group (an —$NH_2$ group) in gelatin is chemically modified.

9. The silver halide photographic material as claimed in claim 3, wherein said silver halide photographic emulsion contains a silver halide emulsion prepared in the presence of gelatin to which at least one carboxyl group (a —COOH group) is newly introduced when the amino group (an —$NH_2$ group) in gelatin is chemically modified.

10. The silver halide photographic material as claimed in claim 4, wherein said silver halide photographic emulsion contains a silver halide emulsion prepared in the presence of gelatin to which at least one carboxyl group (a —COOH group) is newly introduced when the amino group (an —$NH_2$ group) in gelatin is chemically modified.

11. The silver halide photographic material as claimed in claim 1, wherein the silver halide photographic emulsion is produced by the method comprising (a) a process of forming silver halide grain nuclei containing twin crystal grain nuclei in a dispersion medium solution, (b) a process of ripening said silver halide grain nuclei to leave tabular grain nuclei primarily, and (c) a process of growing said tabular grain nuclei to tabular grains, and the Cl content of the nuclei based on the silver amount in process (a) is at least 10 mol % or more.

12. The silver halide photographic material as claimed in claim 2, wherein the silver halide photographic emulsion is produced by the method comprising (a) a process of forming silver halide grain nuclei containing twin crystal grain nuclei in a dispersion medium solution, (b) a process of ripening said silver halide grain nuclei to leave tabular grain nuclei primarily, and (c) a process of growing said tabular grain nuclei to tabular grains, and the Cl content of the nuclei based on the silver amount in process (a) is at least 10 mol % or more.

13. The silver halide photographic material as claimed in claim 3, wherein the silver halide photographic emulsion is produced by the method comprising (a) a process of forming silver halide grain nuclei containing twin crystal grain nuclei in a dispersion medium solution, (b) a process of ripening said silver halide grain nuclei to leave tabular grain nuclei primarily, and (c) a process of growing said tabular grain nuclei to tabular grains, and the Cl content of the nuclei based on the silver amount in process (a) is at least 10 mol % or more.

14. The silver halide photographic material as claimed in claim 4, wherein the silver halide photographic emulsion is produced by the method comprising (a) a process of forming silver halide grain nuclei containing twin crystal grain nuclei in a dispersion medium solution, (b) a process of ripening said silver halide grain nuclei to leave tabular grain nuclei primarily, and (c) a process of growing said tabular grain nuclei to tabular grains, and the Cl content of the nuclei based on the silver amount in process (a) is at least 10 mol % or more.

15. The silver halide photographic material as claimed in claim 1, wherein said silver halide photographic emulsion comprising spectrally sensitized tabular silver halide grains has a light absorption strength per unit surface area of the grain surface of 100 or more by multilayer adsorption of a sensitizing dye to said tabular silver halide grains.

16. The silver halide photographic material as claimed in claim 2, wherein said silver halide photographic emulsion comprises tabular silver halide grains having a light absorption strength per unit surface area of the grain surface of 60 or more and less than 100 by multilayer adsorption of a sensitizing dye to said tabular silver halide grains.

17. The silver halide photographic material as claimed in claim 1, wherein said silver halide photographic emulsion comprising spectrally sensitized tabular silver halide grains has a light absorption strength per unit surface area of the grain surface of 100 or more by adsorption of a linked sensitizing dye to said tabular silver halide grains.

18. The silver halide photographic material as claimed in claim 2, wherein said silver halide photographic emulsion comprises tabular silver halide grains having a light absorption strength per unit surface area of the grain surface of 60 or more and less than 100 by adsorption of a linked sensitizing dye to said tabular silver halide grains.

* * * * *